US009420882B2

(12) United States Patent
Garcia et al.

(10) Patent No.: US 9,420,882 B2
(45) Date of Patent: Aug. 23, 2016

(54) SLIDING AND PIVOTING MECHANISM OF A RACK OF AN ITEM OF FURNITURE, ITEM OF FURNITURE AND DOMESTIC APPLIANCE

(71) Applicant: PAUL HETTICH GMBH & CO. KG, Kirchlengern (DE)

(72) Inventors: Oscar Garcia, San Sebastian (ES); Enaut Arriaga, Ursubil (ES); Iker Lopetegi, Zarautz (ES); Mikel Azkue, Zarauz (ES)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 14/423,899

(22) PCT Filed: Aug. 26, 2013

(86) PCT No.: PCT/EP2013/067646

§ 371 (c)(1),
(2) Date: Feb. 25, 2015

(87) PCT Pub. No.: WO2014/033092

PCT Pub. Date: Mar. 6, 2014

(65) Prior Publication Data

US 2015/0305493 A1 Oct. 29, 2015

(30) Foreign Application Priority Data

Aug. 29, 2012 (DE) ..... 10 2012 107 993

(51) Int. Cl.
*A47G 19/08* (2006.01)
*A47B 46/00* (2006.01)
(Continued)

(52) U.S. Cl.
CPC ..... *A47B 46/005* (2013.01); *A47B 96/07* (2013.01); *A47L 15/504* (2013.01); *A47L 15/506* (2013.01); *A47L 15/507* (2013.01)

(58) Field of Classification Search
CPC .... A47B 46/005; A47B 96/07; A47B 46/00; A47B 97/05; A47L 15/50; A47L 15/504; A47L 14/506; A47L 15/507; A47L 15/508
USPC ..... 211/41.9, 175; 312/228.1, 319.2, 311, 312/322, 323, 334.6, 334.7, 334.8, 350, 312/219.3; 134/56 D
See application file for complete search history.

(56) References Cited

U.S. PATENT DOCUMENTS 2,590,341 A * 3/1952 Nabholz ..... 312/266
2,822,229 A * 2/1958 Carlson ..... 312/27

(Continued)

FOREIGN PATENT DOCUMENTS

DE 20-2009-004771 U1 9/2010
JP 2005-087360 4/2005

OTHER PUBLICATIONS

Search Report and Written Opinion issued in Int'l App. No. PCT/EP2013/067646 (2013).

*Primary Examiner* — Jennifer E Novosad
(74) *Attorney, Agent, or Firm* — Barnes & Thornburg LLP

(57) ABSTRACT

A sliding and pivoting mechanism of a rack of an item of furniture or domestic appliance for extending and raising the rack out of a body of the item of furniture or domestic appliance, having at least two pivoting arms which are fixed rotatably to at least one of the side walls of the body with a first end parallel to the plane of the side walls, and are arranged spaced apart parallel to each other, wherein a guide rail is fixed pivotably to respective second ends of the pivoting arms parallel to the plane of the side walls in such a manner that the guide rail can be pivoted out of a lower position within the body into a raised, upper position at least partially outside the body, and at least one running rail which is displaceable linearly in the guide rail and to which the rack is fastened, wherein the sliding and pivoting mechanism has a locking mechanism which is arranged on the guide rail and on one of the pivoting arms and is actuable by an activator fixed on the running rail in order to prevent a simultaneous pivoting and sliding movement of the running rail.

20 Claims, 27 Drawing Sheets

(51) Int. Cl.
*A47L 15/50* (2006.01)
*A47B 96/07* (2006.01)

(56) References Cited

U.S. PATENT DOCUMENTS

| | | | | |
|---|---|---|---|---|
| 2,919,966 | A * | 1/1960 | Preston | 312/27 |
| 3,081,138 | A * | 3/1963 | Stebbins | 312/319.3 |
| 3,466,108 | A * | 9/1969 | Guth | 312/274 |
| 3,799,640 | A * | 3/1974 | Jacobs | 312/273 |
| 4,134,629 | A * | 1/1979 | Hansen | 312/246 |
| 4,915,461 | A * | 4/1990 | Kingsborough et al. | 312/247 |
| 5,115,822 | A * | 5/1992 | Nichols | 134/135 |
| 5,249,858 | A * | 10/1993 | Nusser | 312/319.6 |
| 5,308,158 | A * | 5/1994 | Vogelgesang et al. | 312/319.3 |
| 5,462,347 | A | 10/1995 | Vogelgesang et al. | |
| 5,971,513 | A * | 10/1999 | Cassalia | 312/310 |
| 6,247,771 | B1 * | 6/2001 | Miller | 312/310 |
| 7,621,605 | B2 * | 11/2009 | Bond et al. | 312/325 |
| 7,731,805 | B2 * | 6/2010 | Banta et al. | 134/56 D |
| 7,770,986 | B1 * | 8/2010 | Simaitis | 312/247 |
| 8,424,693 | B1 * | 4/2013 | Hoover | 211/55 |
| 8,424,983 | B1 * | 4/2013 | Strauss et al. | 312/247 |
| 9,004,622 | B2 * | 4/2015 | Garcia et al. | 312/228.1 |
| 2004/0080245 | A1 | 4/2004 | Lammens et al. | |
| 2004/0163687 | A1 * | 8/2004 | Son et al. | 134/58 D |
| 2005/0206282 | A1 * | 9/2005 | Walburn | 312/312 |
| 2006/0066189 | A1 * | 3/2006 | Bond et al. | 312/319.1 |
| 2012/0074080 | A1 | 3/2012 | Garcia et al. | |
| 2015/0002005 | A1 * | 1/2015 | Park et al. | 312/228.1 |
| 2015/0305493 | A1 * | 10/2015 | Garcia et al. | 211/41.9 |

* cited by examiner

SLIDING AND PIVOTING MECHANISM OF A RACK OF AN ITEM OF FURNITURE, ITEM OF FURNITURE AND DOMESTIC APPLIANCE

CROSS REFERENCE TO RELATED APPLICATIONS

This application is a U.S. nationalization under 35 U.S.C. §371 of International Application No. PCT/EP2013/067646, filed Aug. 26, 2013, which claims priority to German Application No. 10 2012 107993.5, filed Aug. 29, 2012. The disclosures set forth in the foregoing applications are incorporated herein by reference in their entireties.

BACKGROUND AND SUMMARY OF THE DISCLOSURE

The present disclosure relates to a sliding and pivoting mechanism of a rack of an item of furniture or of a domestic appliance for pulling out and raising the rack from a body of the item of furniture. The disclosure further relates to an item of furniture as well as to a domestic appliance with such a sliding and pivoting mechanism.

These types of sliding and pivoting mechanisms are in particular often built into dishwashers, refrigerators, deep freezes (freezers) or cooking appliances in order to pull a bottom dish rack, container or cooked food carrier out of the washing space of the dishwasher, the interior of the fridge or deep freeze or the cooking space of the cooking appliance and at the same time to raise it upward into a position in which it is comfortable for the user to load and unload the dishwasher rack or cooked food carrier.

In the case of the sliding and pivoting mechanism known from DE 20 2009 004 771 U1, the raising or lowering of the rack is supported by means of a tension spring which cooperates with one of the pivot arms and consequently the loading or unloading is made easier insofar as the user is no longer forced to bend down for loading or unloading and consequently strain his back muscles and spine. Access to a lower-lying level is also made easier for wheelchair users, for example, by means of a sliding and pivoting mechanism.

U.S. Pat. No. 5,462,347 A makes known a sliding and pivoting mechanism where a storage compartment can be pulled out of a wall cabinet and then, by means of the sliding and pivoting mechanism, can be lowered in front of a storage compartment mounted below it in order to make access to the storage compartment easier. In order to prevent the lowered storage compartment from being pushed in, a bolt is provided on one of the pivot arms, said bolt protruding into the path of movement of a rear wall of the storage compartment in the lowered position and thus preventing an insertion movement in the lowered position.

Such a sliding and pivoting mechanism has proved its worth in practice. It is desirable to control the sequence of the pulling-out and raising movement or the lowering and pushing-in movement of the rack in a more precise manner in order to avoid, for example, it being raised when the rack is still partly pushed in.

A pivoting and sliding mechanism according to the disclosure may comprise at least two pivot arms which are rotatably secured on at least one of the side walls of a body with a first end parallel to the plane of the side walls, and arranged spaced part from one another in parallel, wherein a guide rail is secured on the respective second ends of the pivot arms so as to be pivotable in such a manner parallel to the plane of the side walls that the guide rail is pivotable from a bottom position inside the body into a raised, top position at least partially outside of the body, at least one running rail which is linearly displaceable in the guide rail and on which the rack is fastened, wherein the sliding and pivoting mechanism further comprises a locking mechanism, which is arranged on the guide rail and on one of the pivot arms, for preventing the running rail from simultaneously sliding and pivoting.

The sequence of the pulling out and raising movement or of the lowering and pushing in movement of the rack can be controlled in a precise manner by means of the locking mechanism such that, for example, the rack being simultaneously raised and extended is effectively prevented. A raising operation with the rack still partially inserted may be avoided as a result.

According to one embodiment of the disclosure, the locking mechanism is actuatable by an activator which is fixed on the running rail.

Because the activator is fixed on the running rail, it is possible to define a predetermined pull-out position of the rack at which a pivoting movement of the sliding and pivoting mechanism is first of all made possible such that a proper sequence of a pull-out movement of the rack from the body of the item of furniture is ensured.

According to one embodiment of the disclosure, the locking mechanism comprises a web, which is held so as to be pivotable and resilient on one of the pivot arms, with a bolt which protrudes in the direction of the guide rail and is guidable along a guide path, which is fastened to the guide rail, from a first locking position into at least one second locking position.

The locking positions, in this case, may be determined by locking grooves which define the guide path which is preferably realized as a curved portion. Precise coordination of the movement sequence of the pivot arms is made possible as a result of the bolt which is guided along the guide path.

According to a further embodiment of the sliding and pivoting mechanism according to the disclosure, the activator used to activate the locking mechanism comprises a first stop, by way of which the locking bolt can be moved in a direction of extension out of a position blocking a pivoting movement of the pivot arm in the first locking groove when the running rail is pulled out. As a result of the positioning of the activator at a predetermined position of the running rail, the trigger point of the pivoting movement of the pivot arms is determined in a simple and precise manner.

To guide the pivoting movement of the pivot arms in a precise manner, according to a further embodiment, the activator, which is fixed on the running rail, comprises a guide which guides the locking bolt along the guide path when the pivot arms are pivoted. As a result, the locking bolt is guided in a guide groove formed by the abovementioned components and can latch into the second locking groove once the rack has reached the upwardly pivoted position.

In order, once the loading or unloading has been carried out, to enable the rack to pivot back into the body, according to a further embodiment the activator, which is fixed on the running rail, comprises a web which rises in the manner of a ramp, by way of which the locking bolt can be moved in a direction of extension out of a position blocking a pivoting movement of the pivot arms in the second locking groove when the running rail is pulled out.

In a further embodiment of the disclosure, the activator comprises at least one fastening element for fixing the rack such that no further component is necessary on the running rail for fixing the rack and the activator serves for fixing the rack at the same time.

To guide the locking bolt precisely and to position it reliably in a locking groove, the locking bolt is preferably guided in a guide groove of the second guide arm which is aligned perpendicular to the longitudinal extension of the second guide arm. This ensures a simply linear movement of the locking bolt in relation to the second guide arm as the locking bolt itself, as already mentioned above, is fixed on a web which is held so as to be pivotable and resilient on the second pivot arm.

In order to make the raising and lowering of the rack additionally easier, a raising and/or lowering aid is secured on at least one of the side walls of the body and on one of the pivot arms for supporting the pivoting movement of the pivot arms.

To shield from contamination and/or to avoid, for example, a finger of a user from becoming caught, according to an embodiment, a cover, which covers the side face of the sliding and pivoting mechanism at least in part, can be arranged on the side of the sliding and pivoting mechanism remote from the rack.

To be able to detect a locking position which prevents the running rail from simultaneously pivoting and sliding or the reaching of said locking position, the locking position according to one embodiment of the disclosure is perceivable in an acoustic or visual manner. To this end, in one case a spring element can be latched in an acoustically perceivable manner in or on a projection which is provided on the pivot arm and in the second case a web with a visually recognizable control strip for indicating the locking position or the non-locking position of the sliding and pivoting mechanism is provided on the cover.

A runner system can include a guide rail, a running rail and as an option at least one center rail.

The sliding and pivoting mechanism can be secured in the body of an item of furniture or of a domestic appliance in a materially bonding, positive locking and/or non-positive locking manner.

The rack can be realized, for example, as a cooked food carrier, as a dish rack, as a drawer, as a container for refrigerated or frozen products or as a pull-out shelf.

The term item of furniture in the sense of this document also includes, for example, devices for laboratories, surgeries, workshops, ships, yachts, vehicles, caravans and mobile homes.

BRIEF DESCRIPTION OF THE DRAWINGS

Exemplary embodiments of the disclosure are explained in more detail below by way of the accompanying drawings, in which:

FIGS. 5 and 6 show perspective representations of the sliding and pivoting mechanism in a position in which the pivoting movement of the pivot arms is released, wherein FIG. 6 shows a representation of a detail of the cutout shown by way of the region marked VI in FIG. 5;

FIGS. 7 and 8 show a perspective representation of the sliding and pivoting mechanism corresponding to FIGS. 5 and 6 during a pivoting movement, wherein FIG. 8 shows a representation of a detail of a cutout marked with VIII in FIG. 7;

FIGS. 9 and 10 show a representation of the sliding and pivoting mechanism corresponding to FIGS. 7 and 8 in a further progressed state of the pivoting movement, wherein FIG. 10 shows a representation of a detail of the cutout marked with X in FIG. 9;

FIGS. 11 and 12 show a representation of the sliding and pivoting mechanism corresponding to FIGS. 9 and 10 directly prior to locking the sliding and pivoting mechanism in the upwardly pivoted position, wherein FIG. 12 shows a representation of a detail of the cutout marked with XII in FIG. 11;

FIGS. 13 and 14 show a representation of the sliding and pivoting mechanism corresponding to FIGS. 11 and 12 in a further pivot-blocking position, wherein FIG. 14 shows a representation of a detail of the cutout marked with XIV in FIG. 13;

FIGS. 15 and 16 show a view of the sliding and pivoting mechanism corresponding to FIGS. 13 and 14 during the release of the sliding and pivoting mechanism out of the top locking position, wherein FIG. 16 shows a representation of a detail of the cutout marked with XVI in FIG. 15;

FIGS. 17 and 18 show a view of the sliding and pivoting mechanism corresponding to FIGS. 15 and 16 directly after the release position shown in FIGS. 15 and 16, as a result of which a renewed lowering of the sliding and pivoting mechanism is released, wherein FIG. 18 shows a representation of a detail of the cutout marked with XVIII in FIG. 17;

FIGS. 19 and 20 show a representation of the sliding and pivoting mechanism corresponding to FIGS. 17 and 18 after the complete re-lowering of the sliding and pivoting mechanism directly prior to the returning of the locking bolt into the blocking position, wherein FIG. 20 shows a representation of a detail of the cutout marked with XX in FIG. 19;

FIGS. 21 and 22 show a view of the sliding and pivoting mechanism corresponding to FIGS. 19 and 20 after reaching the position of the locking bolt in which an upward pivoting of the sliding and pivoting mechanism is blocked, wherein FIG. 22 shows a representation of a detail of the cutout marked with XII in FIG. 21;

FIGS. 33 and 34 show perspective representations of the sliding and pivoting mechanism in the top locking position in the non-locked state, wherein FIG. 34 shows a representation of a detail of the cutout marked with XXXIV in FIG. 33 and FIGS. 35 and 36 show the perspective representations of the sliding and pivoting mechanism shown in FIGS. 33 and 34 in the locked state, wherein

In the following description of the figures terms such as above, below, left, right, front, back etc. relate exclusively to the representation and position chosen as an example in the respective figures of the sliding and pivoting mechanism, the pivot arms, the guide rails, the running rail, the activator and the like. Said terms are not to be understood as limiting. This means said preferences can be modified as a result of different operating positions or the mirror-symmetrical design or the like.

FIGS. 1 to 22 show a first embodiment of a sliding and pivoting mechanism according to the disclosure, positions of the sliding and pivoting mechanism during the course of a raising operation and a subsequent lowering operation being shown as an example.

In this case, the sliding and pivoting mechanism according to the disclosure is used for pulling out and raising or lowering and pushing in a rack 15, shown as an example in FIGS. 25 to 28, of a domestic appliance, such as the dishwasher 1 shown here, but it can also be built in general into items of furniture with a rack 15 which is to be able to be pulled out from a body 2 and raised into an elevated position in order to make it possible to load and unload the rack in a comfortable manner.

In each case in pairs, FIGS. 1 to 22 show a perspective general view of an embodiment of the sliding and pivoting mechanism in a first of the respective pair of figures and in a second of the respective pair of figures a front view of a detail of a cutout marked by a circle in the first of the pair of figures.

Figure 1:
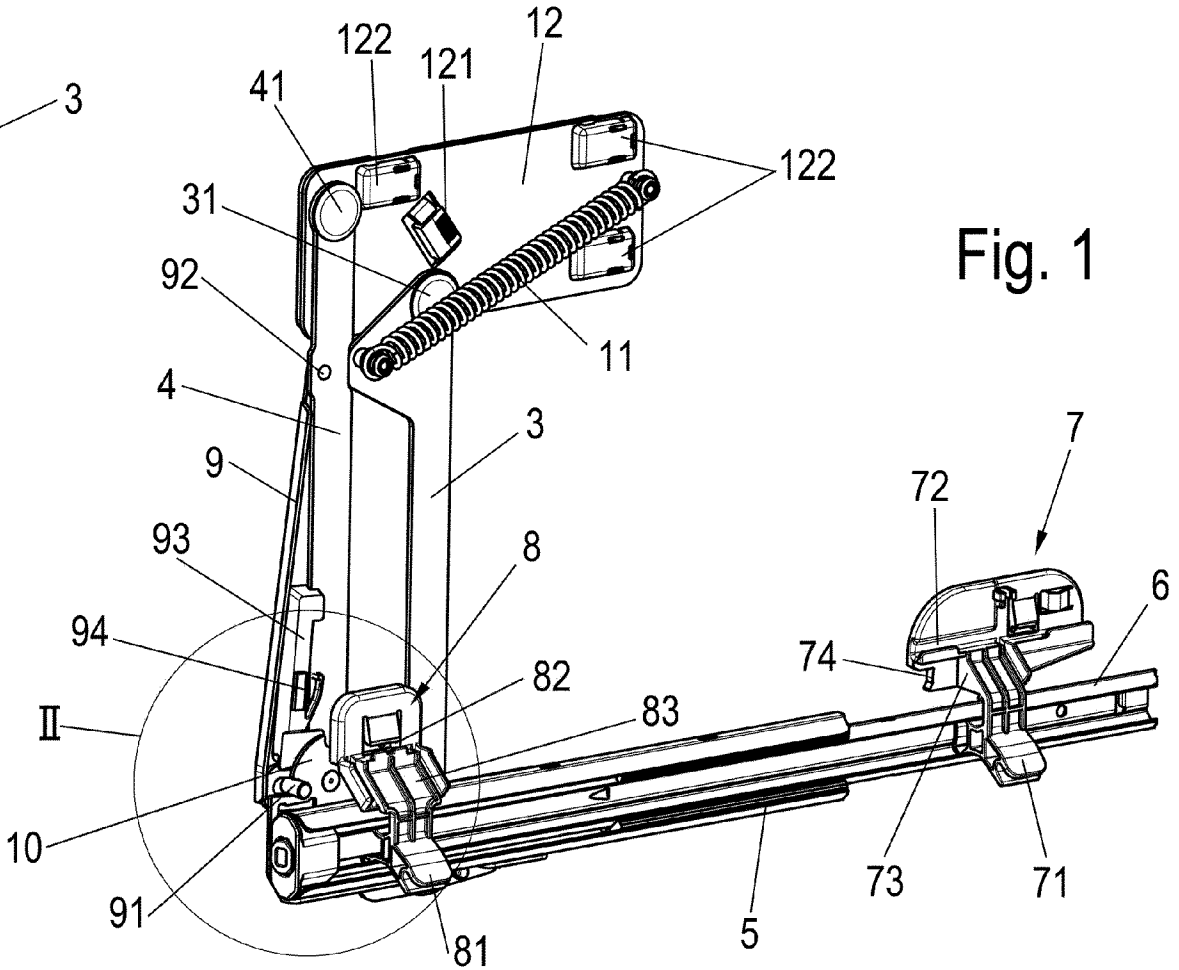
FIGS. 1 and 2 show a perspective view of an embodiment of a sliding and pivoting mechanism according to the disclosure in a completely lowered position as well as a representation of a detail of the region marked with II in FIG. 1.
Figure 26:
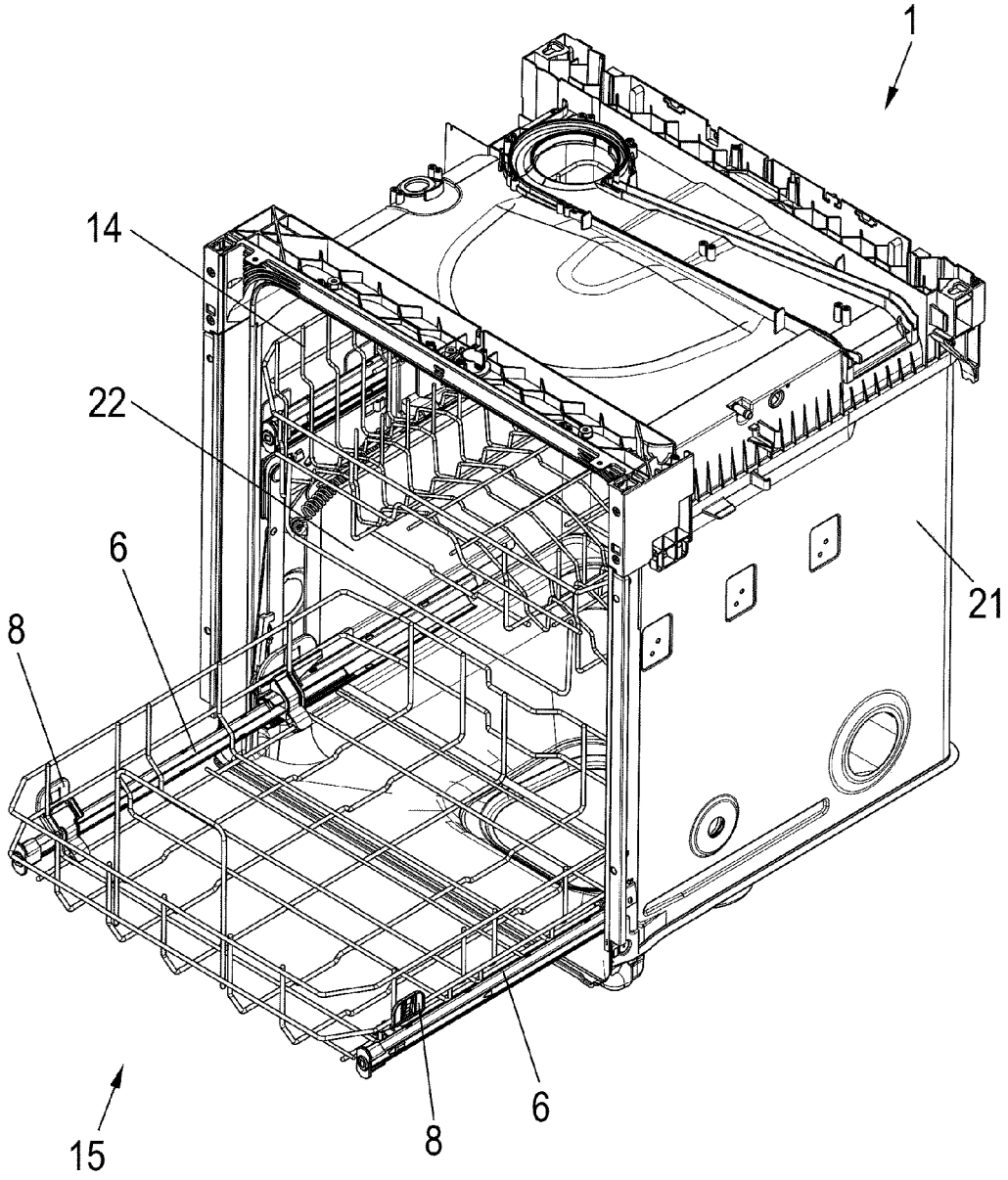
Figure 27:
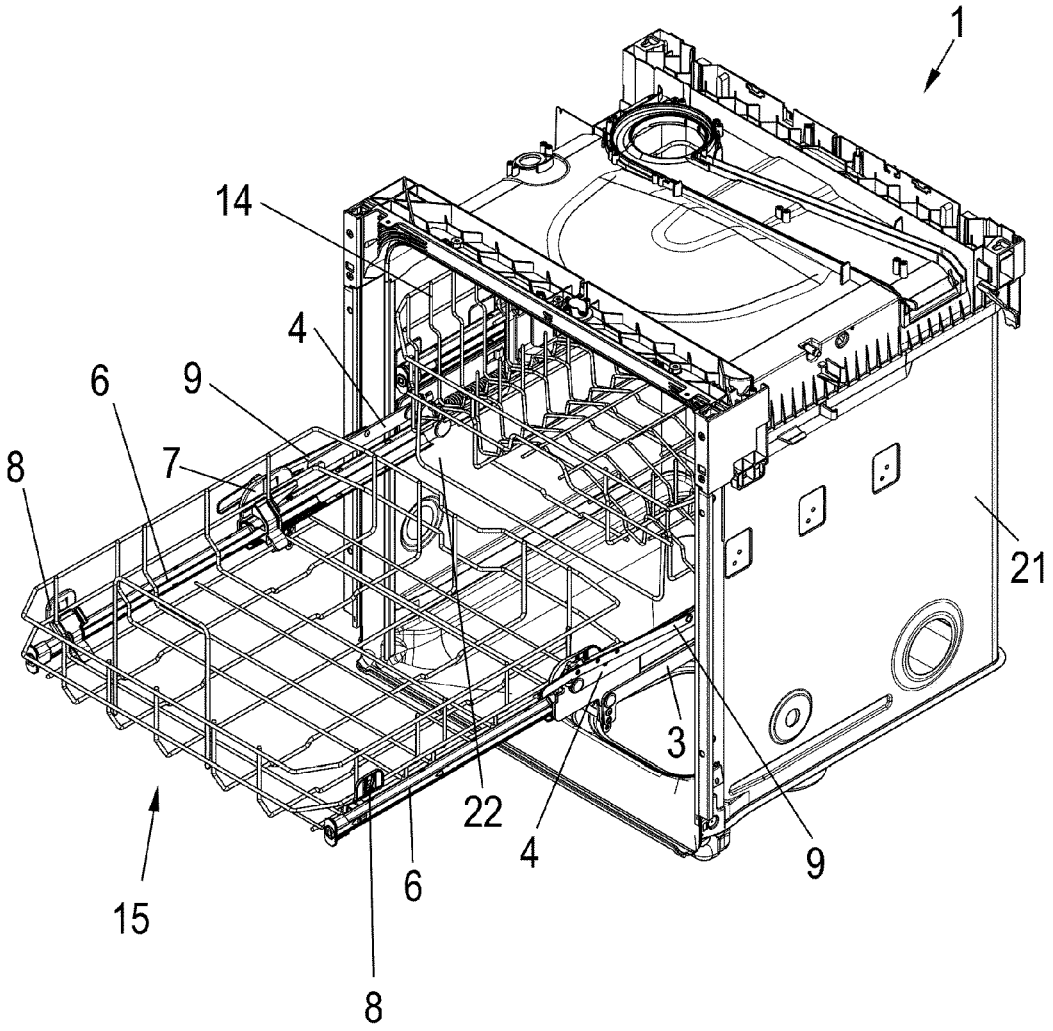
Figure 28:
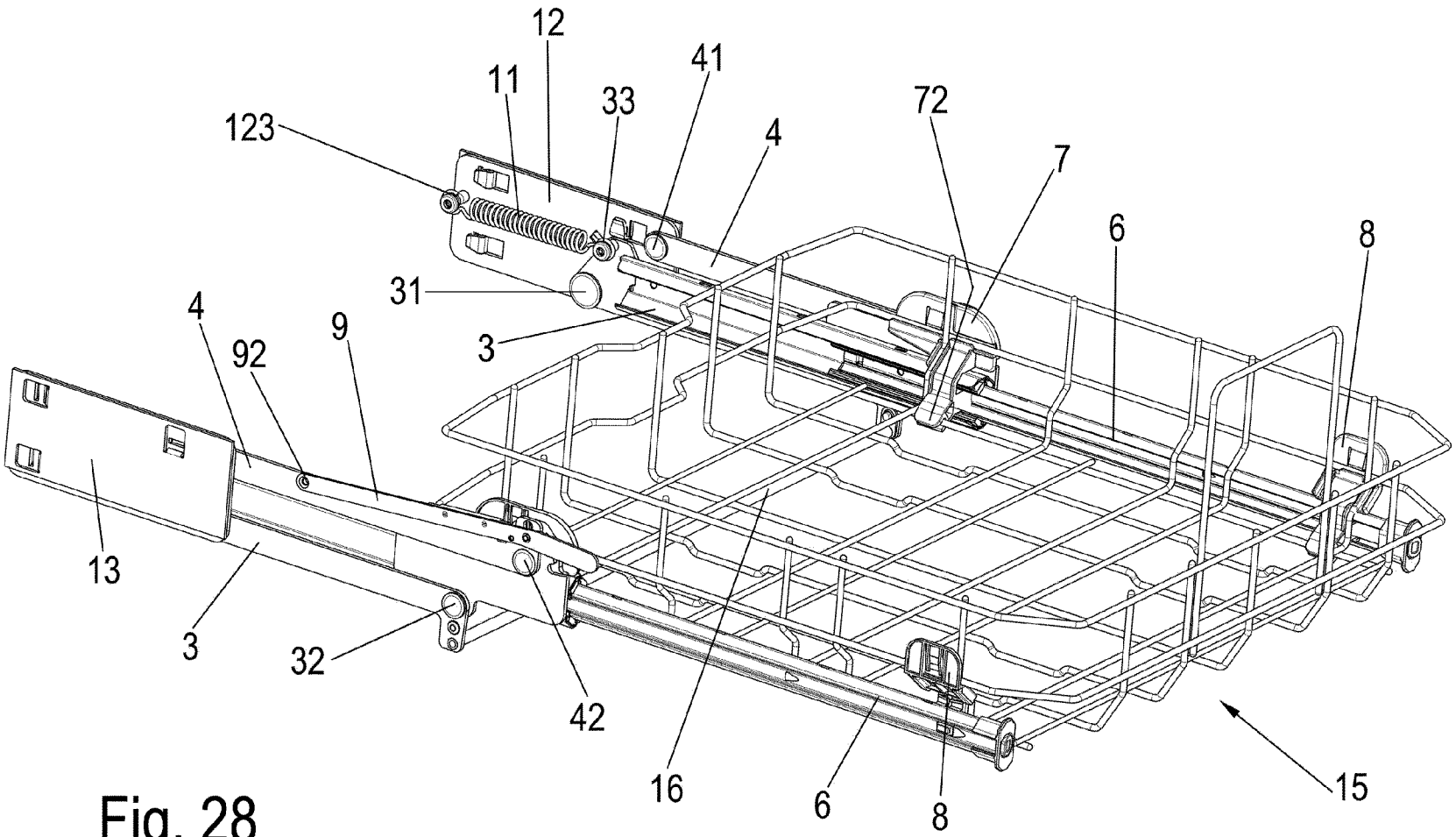
FIG. 28 shows a perspective view of a rack, which is fastened on the sliding and pivoting mechanism, in the extended state.
Figure 30:
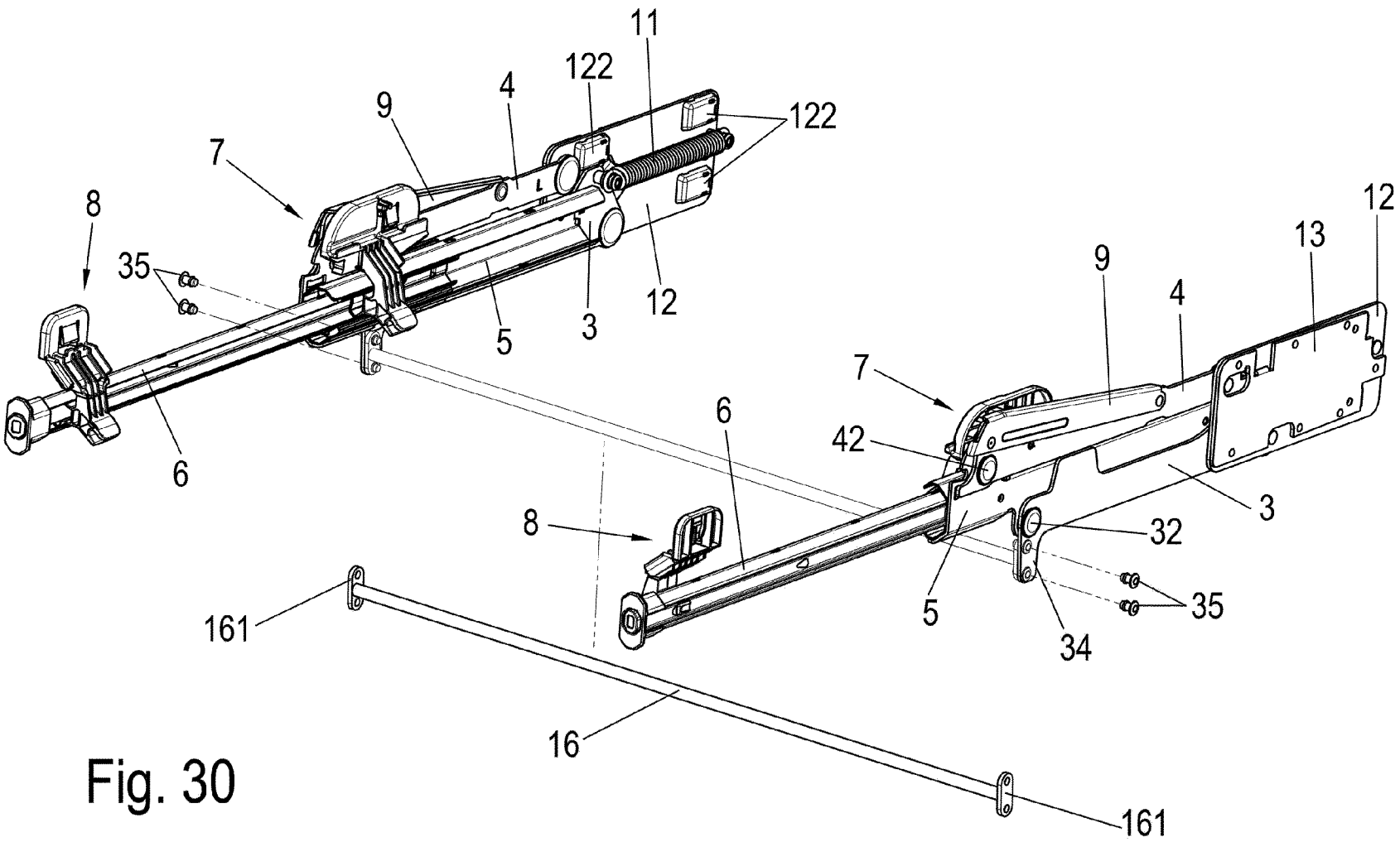
FIG. 30 shows a perspective view of the sliding and pivoting mechanism show in FIG. 28 without showing the rack in the extended state.

As is shown, for example, in FIG. 1, the sliding and pivoting mechanism comprises at least two pivot arms 3, 4 which are rotatably fixed on at least one of the side walls 21, 22 (shown in FIGS. 25 to 27) of a body 2 with a first end parallel to the plane of the side walls 21, 22 and are arranged spaced apart from one another in parallel. The second end of the pivot arms 3, 4, in this case, is secured so as to be rotatable on a guide rail 5 of a runner system, in which the at least one running rail 6 can be moved in a linear manner and on which the rack 15 is secured by means of the activator 7 and the fixing device 8. The pivot arms 3, 4 are fastened, in this case, on the side wall 21, 22 of the body 2, preferably by means of a side wall holder 12 which can be mounted on a side wall 21, 22 and on which the pivot arms 3, 4 are secured so as to be pivotable by means of respective pivot joints 31, 41. The pivot arms 3, 4, in this case, are fastened on the guide rail 5 so as to be pivotable by means of further pivot joints 32, 42 (shown in FIG. 28) such that the guide rail 5, when the pivot arms 3, 4 pivot, remaining in the horizontal position can be pivoted out of a bottom position inside the body 2 into a raised top position at least partially outside the body 2, as is shown in FIGS. 26 and 27. A synchronization element 16 for synchronizing the movement of the pivot arms 3 is provided between shoulders 34 of the pivot arms 3 which are arranged on both sides of the rack 15. The synchronization element 16, in this case, is realized in a preferred manner as a bar that is fastened to the shoulders 34 for example with rivets 35, fastening plates 161 with bores for pushing through the rivets 35 being provided on the ends of the bar, as is shown in FIGS. 28 and 30.

To support the raising or lowering movement, a raising and/or lowering aid 11 for supporting the pivoting of the pivot arms 3, 4 is provided on at least one of the side walls 21, 22 or on the side wall holder 12. The raising or lowering aid 11, in this case, is realized in a preferred manner as a tension spring 11 which is fastened on respective bolts 33, 123 at the one end on the side wall holder 12 and at the other end on a first of the pivot arms 3.

It is also conceivable for the raising and/or lowering aid 11 to be realized as a pneumatic spring. As a result, it is possible to provide higher forces with the installation space remaining the same. The pneumatic spring additionally comprises the advantage of a closed system, consequently, in contrast to tension springs in the form of spiral springs, does not have any hollow or intermediate spaces in which contamination or rinsing water residue is able to collect.

In order to prevent the pivot arms 3, 4 rotating beyond the top end position, a stop 121 is realized in a preferred manner on the side wall holder 12, against which stop the upper end face of the first pivot arm 3 strikes when the top end position is reached. In an embodiment, the stop 121, in this case, is provided on the stop face with an elastic material, for example, a rubber coating, in order to prevent the pivot arm 3 from striking in a hard and noisy manner against a stop 121 which is otherwise realized, for example, as a metal part.

In order to prevent the rack 15 and consequently also the sliding and pivoting mechanism from pivoting and sliding simultaneously, the sliding and pivoting mechanism comprises a locking mechanism which is arranged on the guide rail 5 and on one of the pivot arms 3, 4 and is actuatable by means of an activator 7 which is fixed on the running rail 6.

The locking mechanism, in this case, preferably comprises a web 9, which is held so as to be pivotable and resilient on one of the pivot arms 3, 4, with a bolt 91 which protrudes in the direction of the guide rail 6 and is guidable along a guide path 103 which is fastened on the guide rail 5. Said guide path 103 is realized in a preferred manner as part of a plate 10 which is fastened on the guide rail 5, part of the edge of the plate 10 forming the guide path 103 which is defined by the respective locking grooves 101, 102 and the guide path 103 being realized in a preferred manner as a curve portion along which the bolt 91 is guided during the pivoting movement of the pivot arms 3, 4.

The web 9, in this case, is held on the second pivot arm 4 by means of a pivot bolt 92, the bolt 91 being guided in a preferred manner in a guide groove 44 of the second pivot arm 4 such that the web 9 is able to move away from a side edge of the pivot arm 4 corresponding to the longitudinal extension of said guide groove 44 at its end spaced from the pivot bolt 92. A spring element 94 between the web 9 and the second pivot arm 4, in this case, is developed in such a manner that the bolt 91 is always pulled in the direction of the plate 10.

Figure 31A:
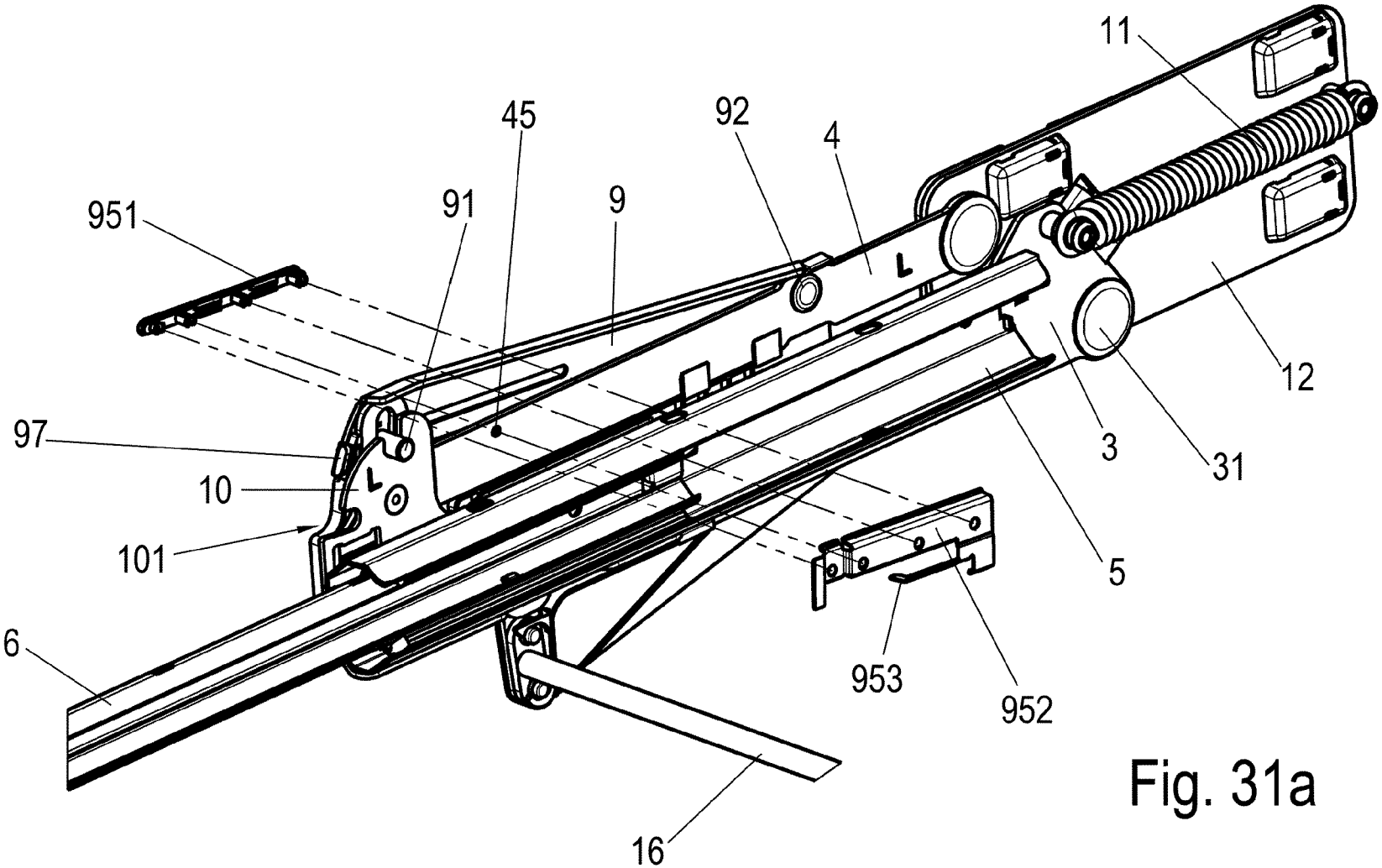
FIGS. 31*a* and 31*b* shows perspective views of the sliding and pivoting mechanism in the top locking position, showing the mounting of a spring element for preventing unwanted release of the sliding and pivoting mechanism out of said locking position.
Figure 31B:
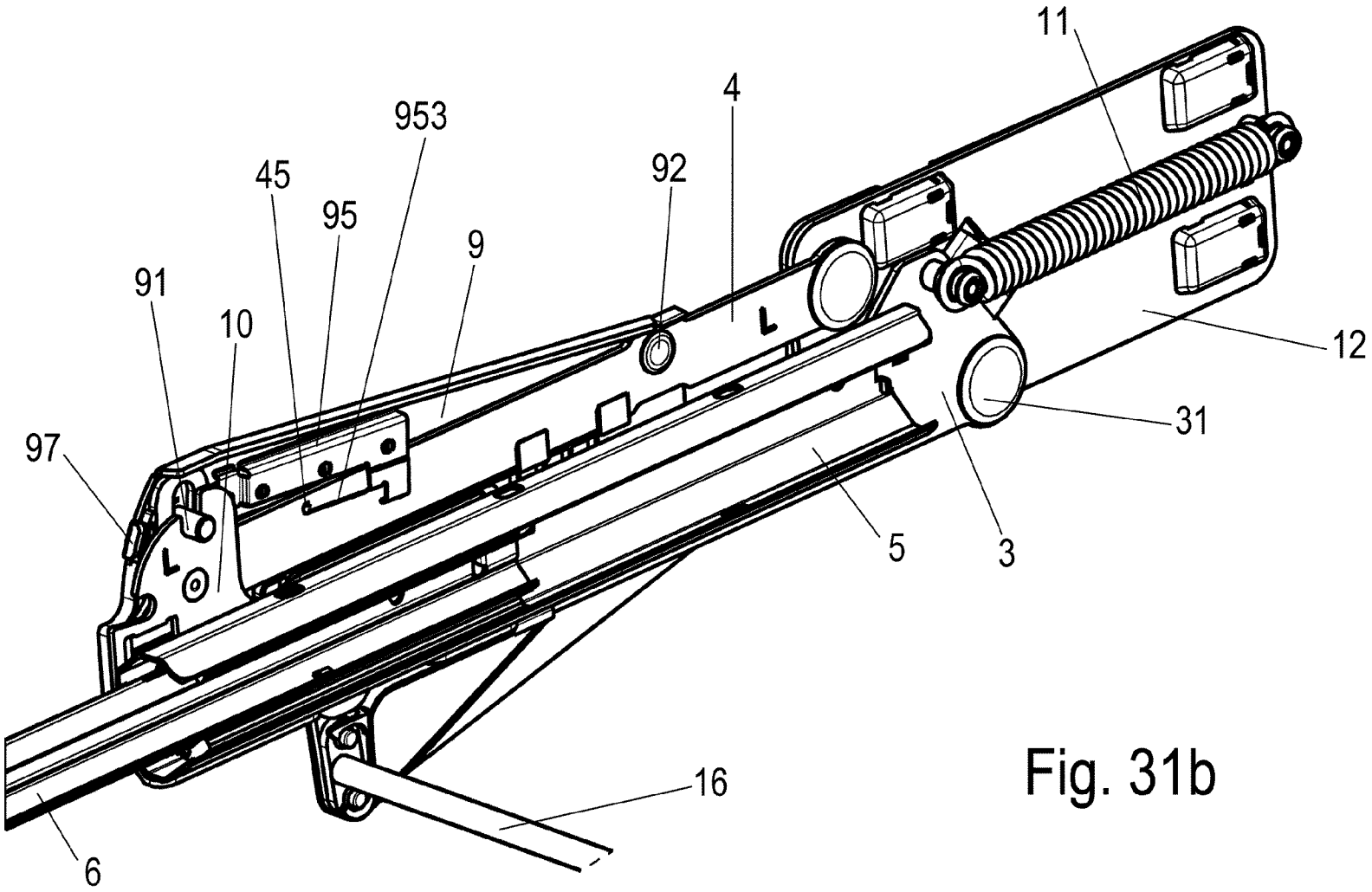
Figures 32A, 32B:
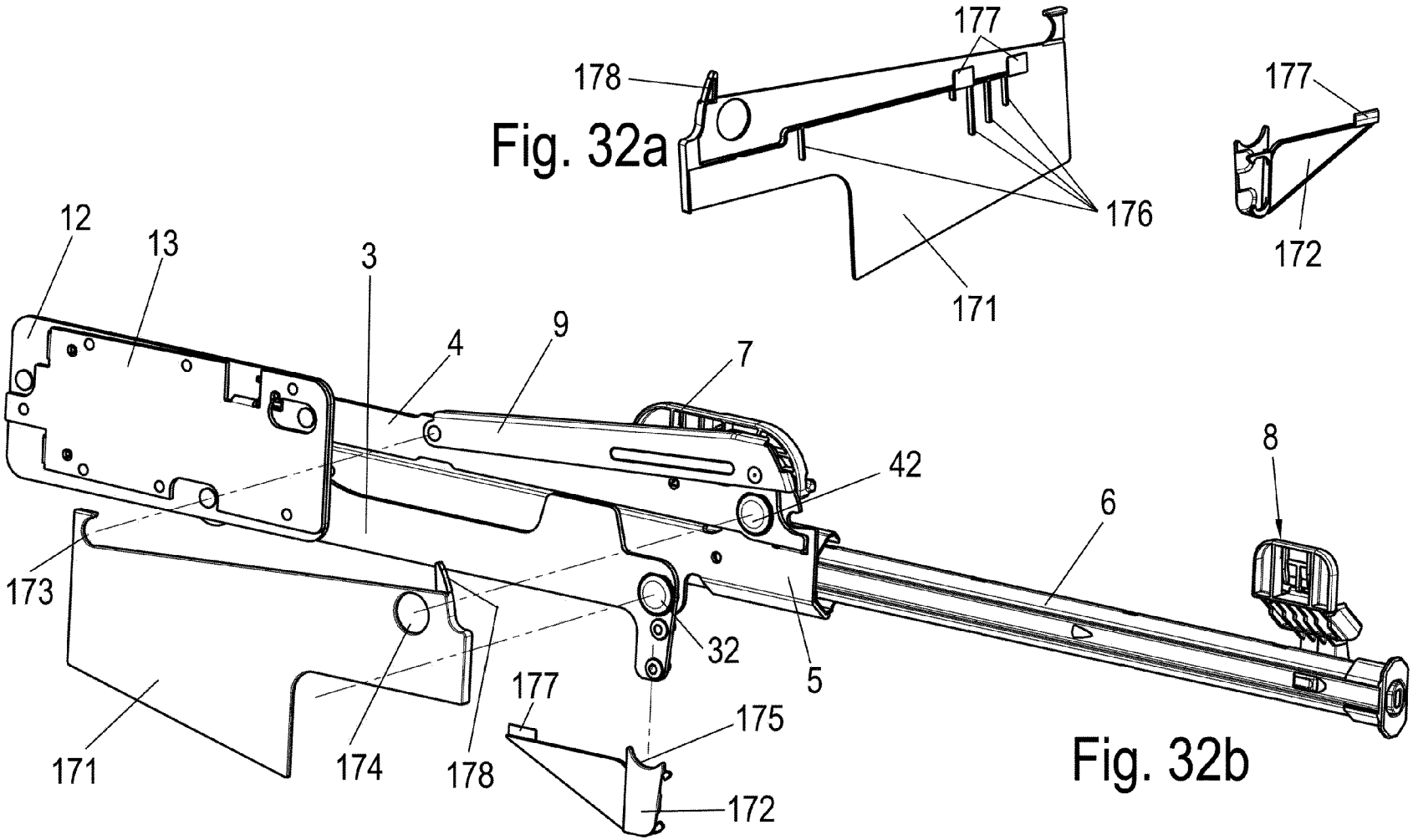
FIGS. 32*a* to 32*c* show perspective views of a side cover of the sliding and pivoting mechanism as well as of the arrangement of said side cover on the sliding and pivoting mechanism.
Figure 32C:
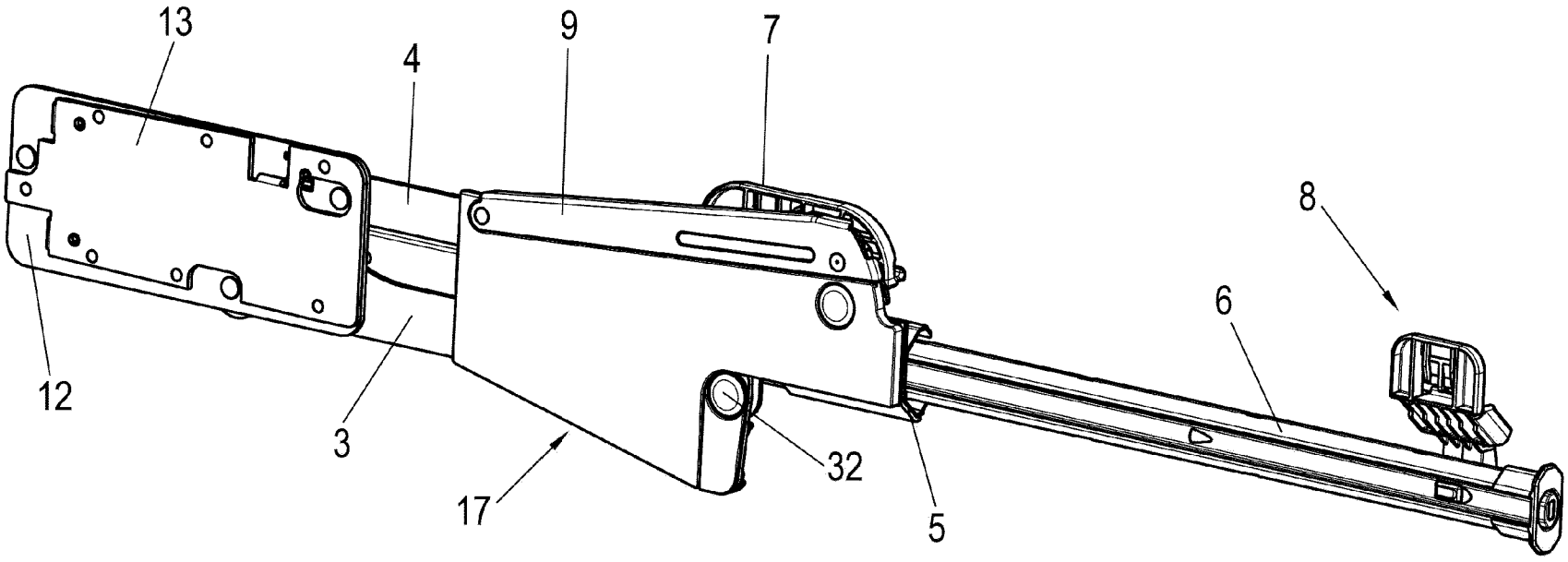

In an alternative embodiment shown in FIGS. 31*a*) and *b*), the web 9 is connected to the pivot arm 4 by means of a spring element 95 which is positioned in such a manner that it acts upon the bolt 91 with a force, as a result of which the bolt 91 is prevented from being released unintentionally out of the locking groove 102. The spring element 95 is realized in an embodiment as a plastics material element that interacts with a projection on the pivot arm 4.

In the embodiment shown here, the spring element 95 is realized in multiple parts and consists of a first housing part 951 and a second housing part 952 which are connected together, in particular by means of riveting or clipping, on both sides of the web 9 through an elongated hole 96 which is punched in the web 9. A spring arm 953 which is mounted by way of its free end in a hole 45 in the pivot arm 4, is integrally molded on the second housing part 952.

It is also conceivable to realize the locking of the bolt such that it has to be released actively by the user, for example by pressing a button or pulling a bar.

Figure 2:
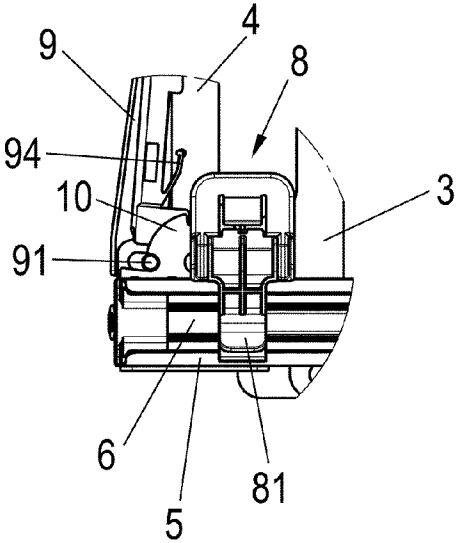

The activator 7, which is fastened on the running rail, comprises a stop 74 on its end face which points in the direction of extension A. The stop 74 serves the purpose of moving the locking bolt 91 out of a position blocking a pivoting movement of the pivot arms 3, 4 in the first locking groove 101 when the running rail 6 is pulled out. FIGS. 1 and 2 show here the position of the sliding and pivoting mechanism in which the rack still rests completely in the body 2. As can be seen clearly in FIG. 2, the bolt 91 rests in the locking groove 101 of the plate 10 such that a pivoting movement of the pivot arms 3, 4 is blocked. The activator 9, which is fastened on the running rail, serves in a preferred manner at the same time for fixing the rack 15 and for this reason comprises, for example, clamping grooves 71, 72.

Figure 3:
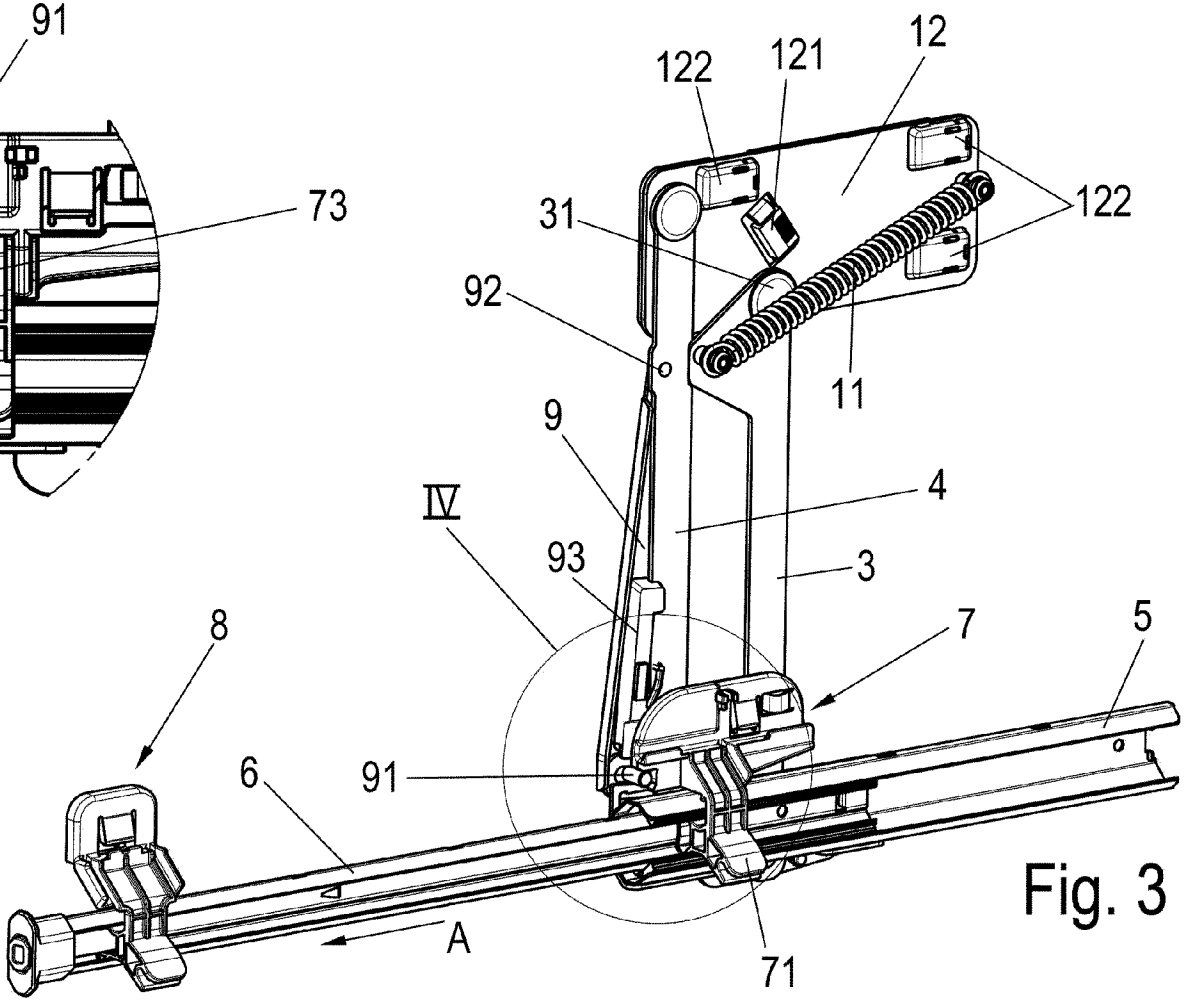
FIGS. 3 and 4 show perspective views of the sliding and pivoting mechanism from FIG. 1 once the running rail has been displaced out of the guide rail prior to raising the sliding and pivoting mechanism as well as a representation of a detail of the region marked with IV in FIG. 3.
Figure 4:
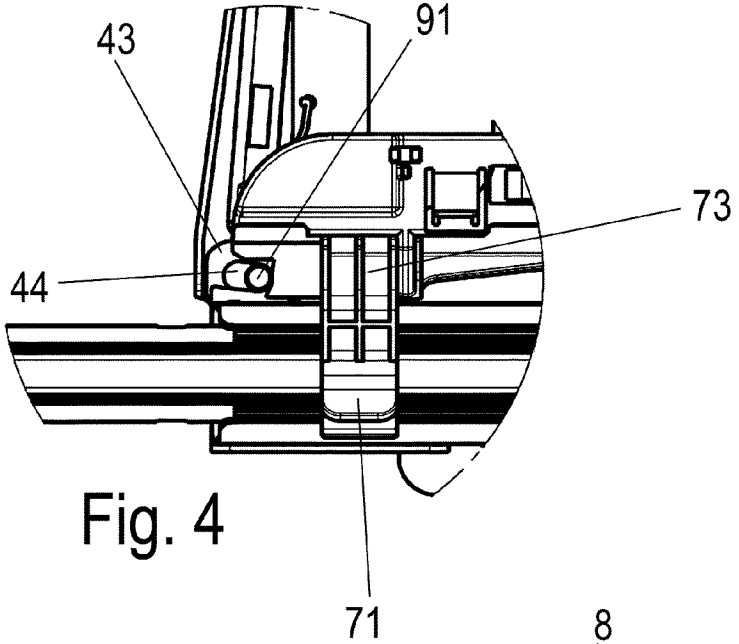
Figure 5:
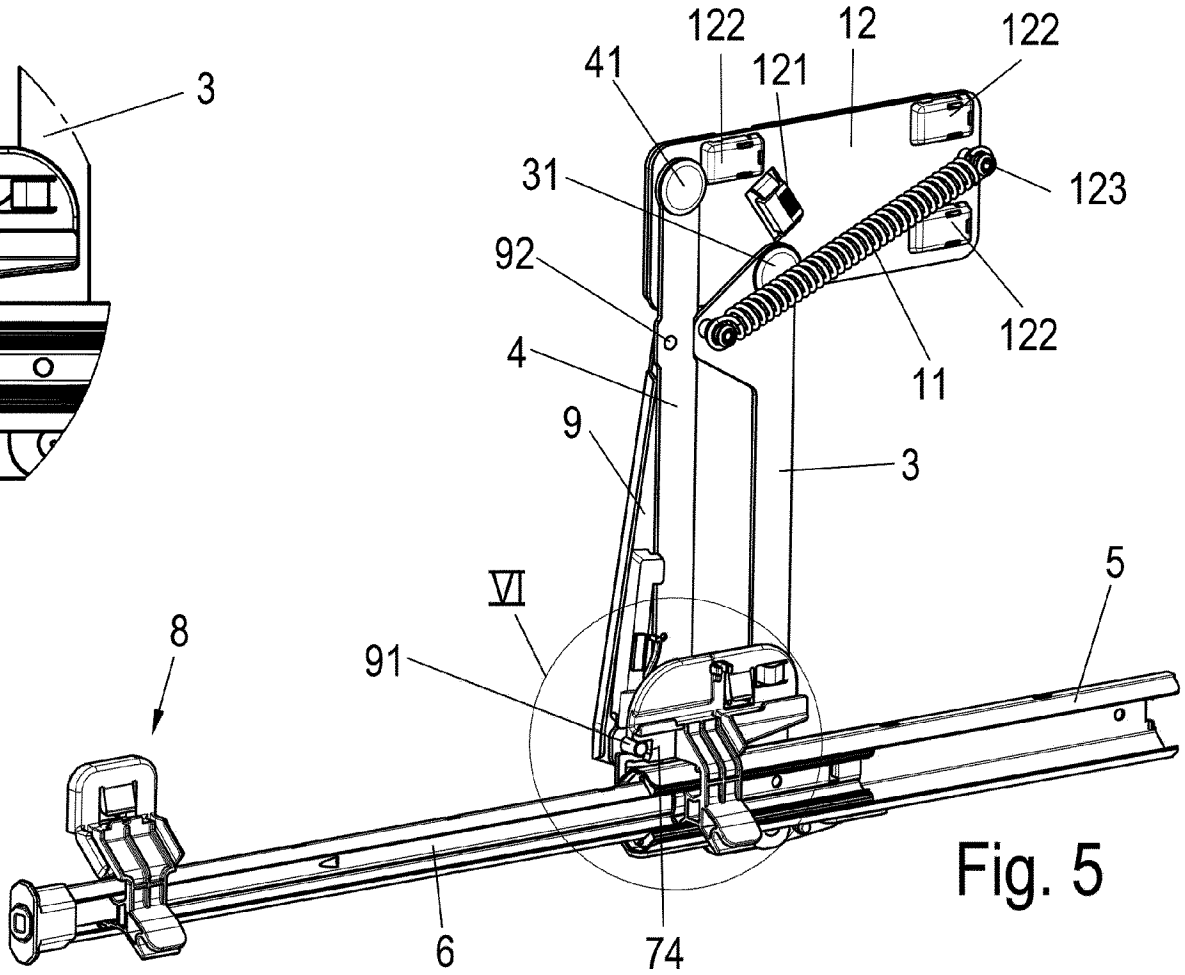
Figure 6:
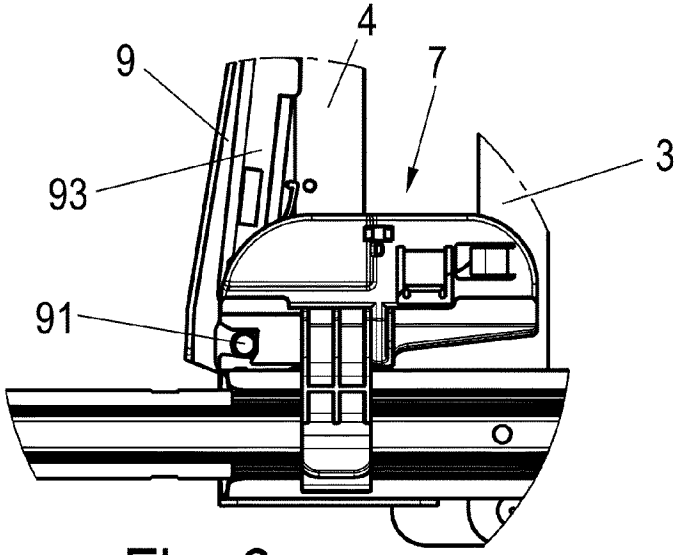
Figure 7:
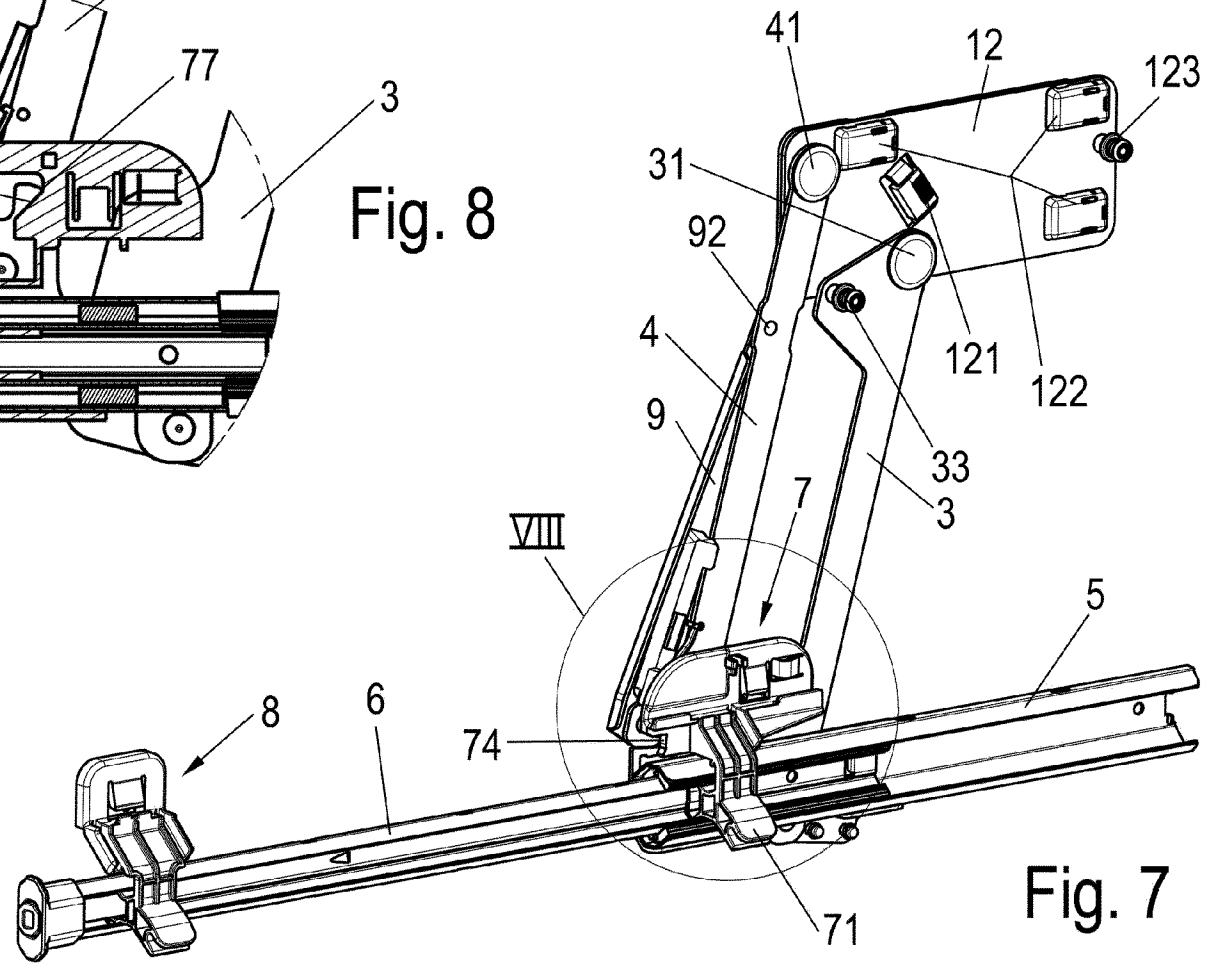
Figure 8:
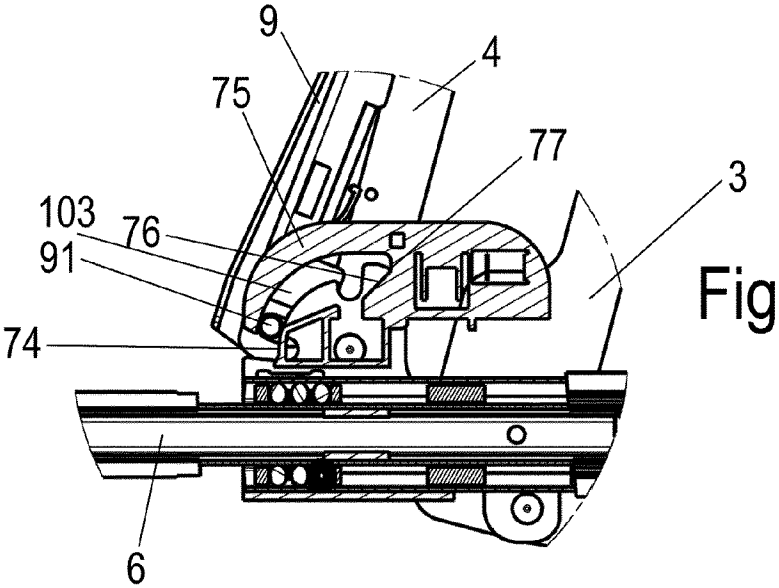

FIGS. 3 and 4 show the position of the sliding and pivoting mechanism where the running rail 6 is displaced in the direction of extension A in relation to the guide rail 5. The activator 7, in this case, is displaced forward in the direction of extension A by the movement of the running rail 6 until the stop 74 abuts directly against the bolt 91. Further displacement of the running rail 6 in the direction of extension A then initially causes, as shown in FIGS. 5 and 6 or 7 and 8, the bolt 91 to be pushed out of the locking groove 101 into the region of the guide path 103, as is shown in the view of the detail in FIG. 8, in which the pivoting movement of the pivot arms 3, 4 is then made possible.

Figure 9:
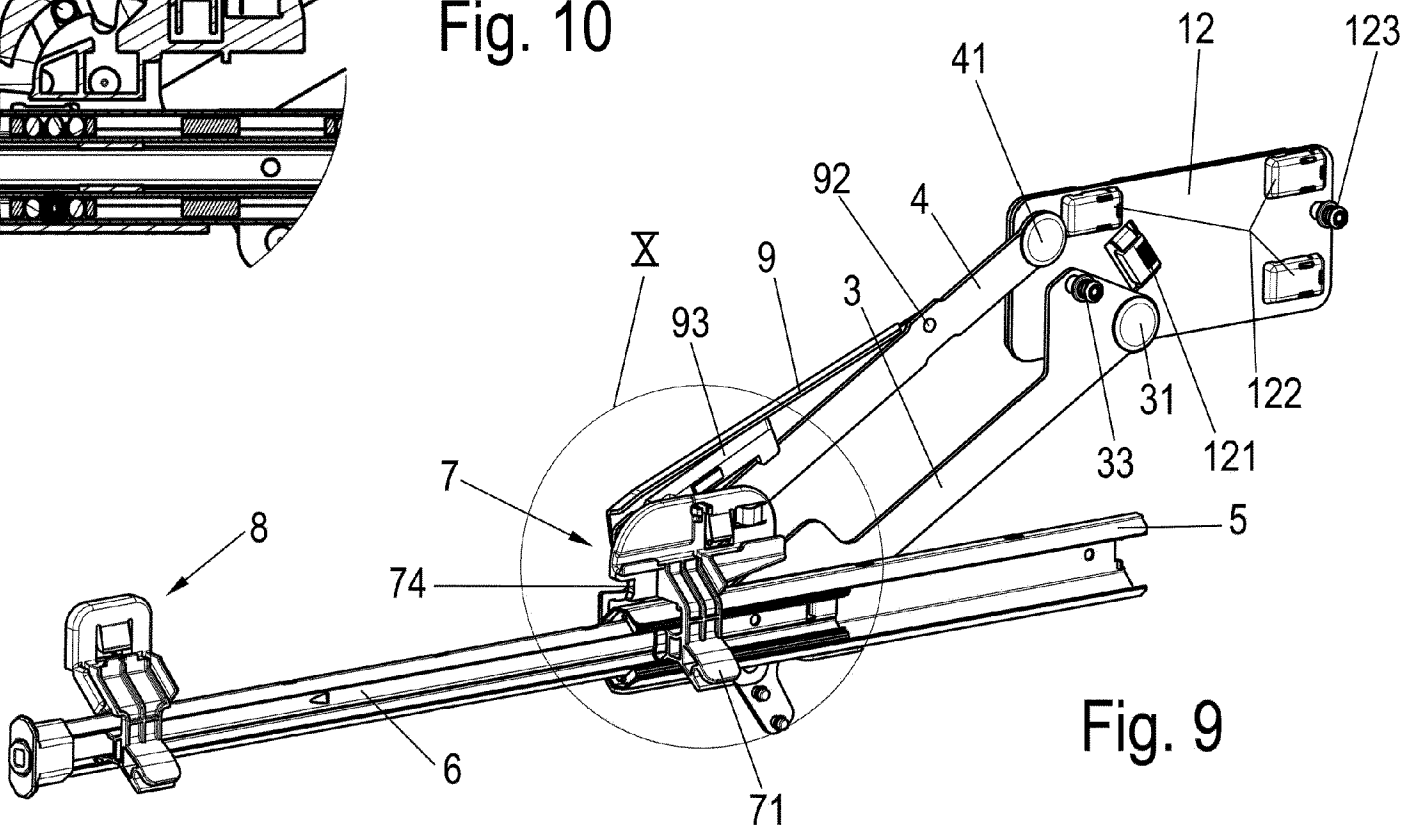
Figure 10:
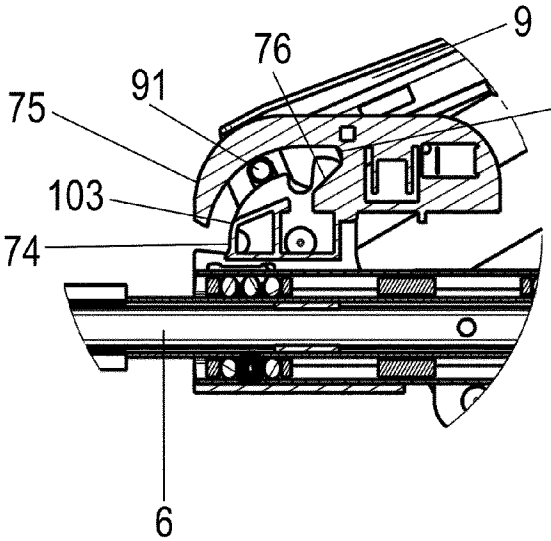
Figure 11:
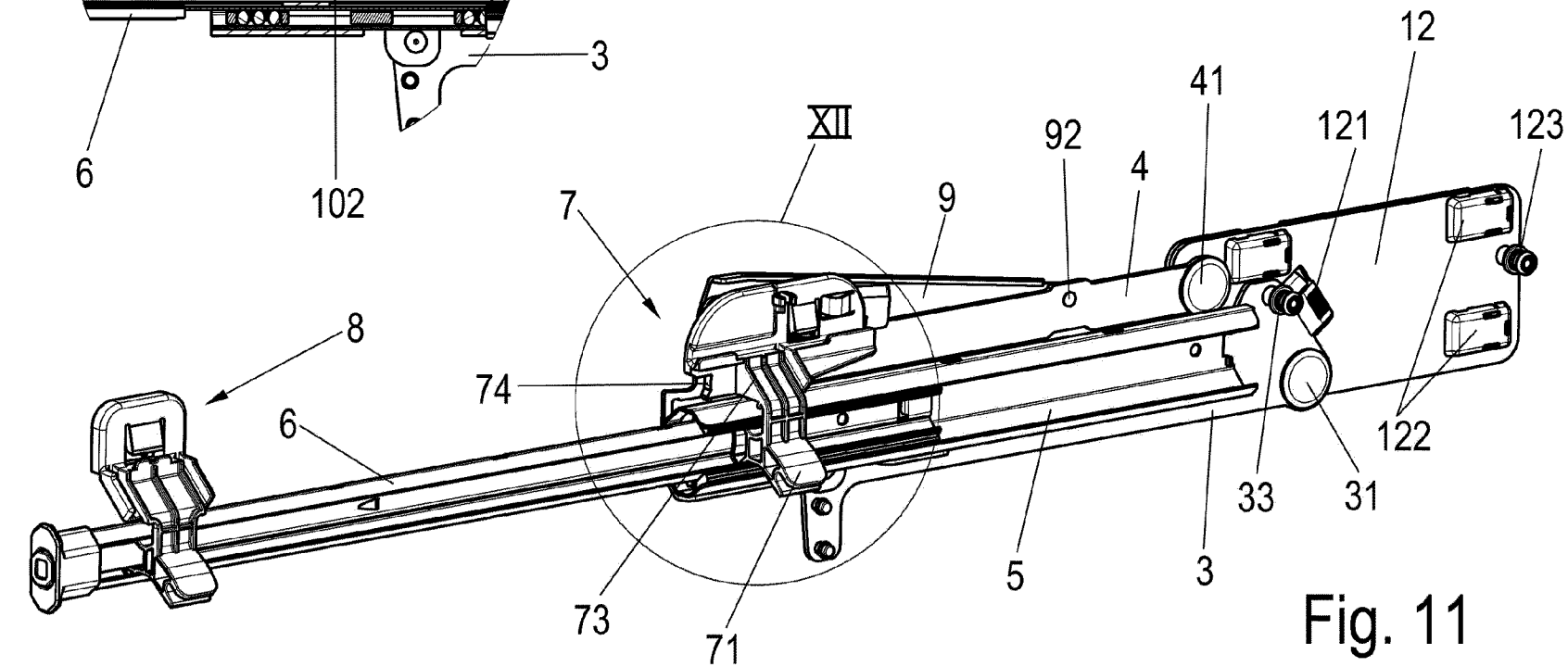
Figure 12:
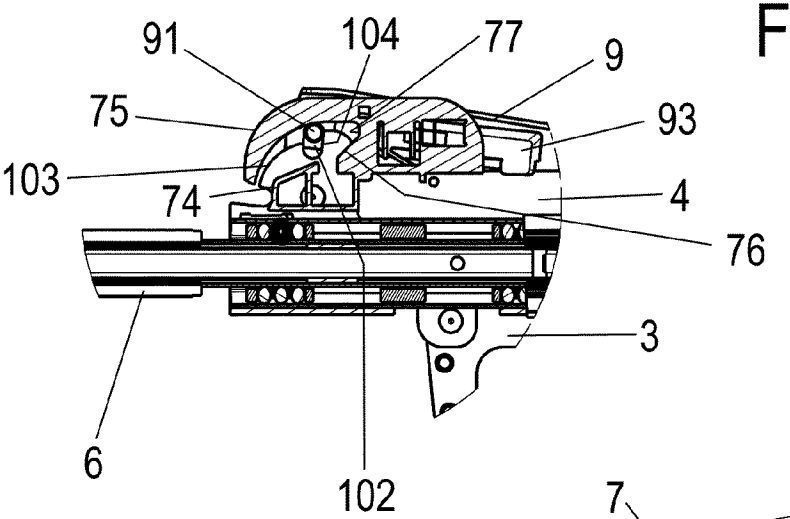
Figures 13, 14:
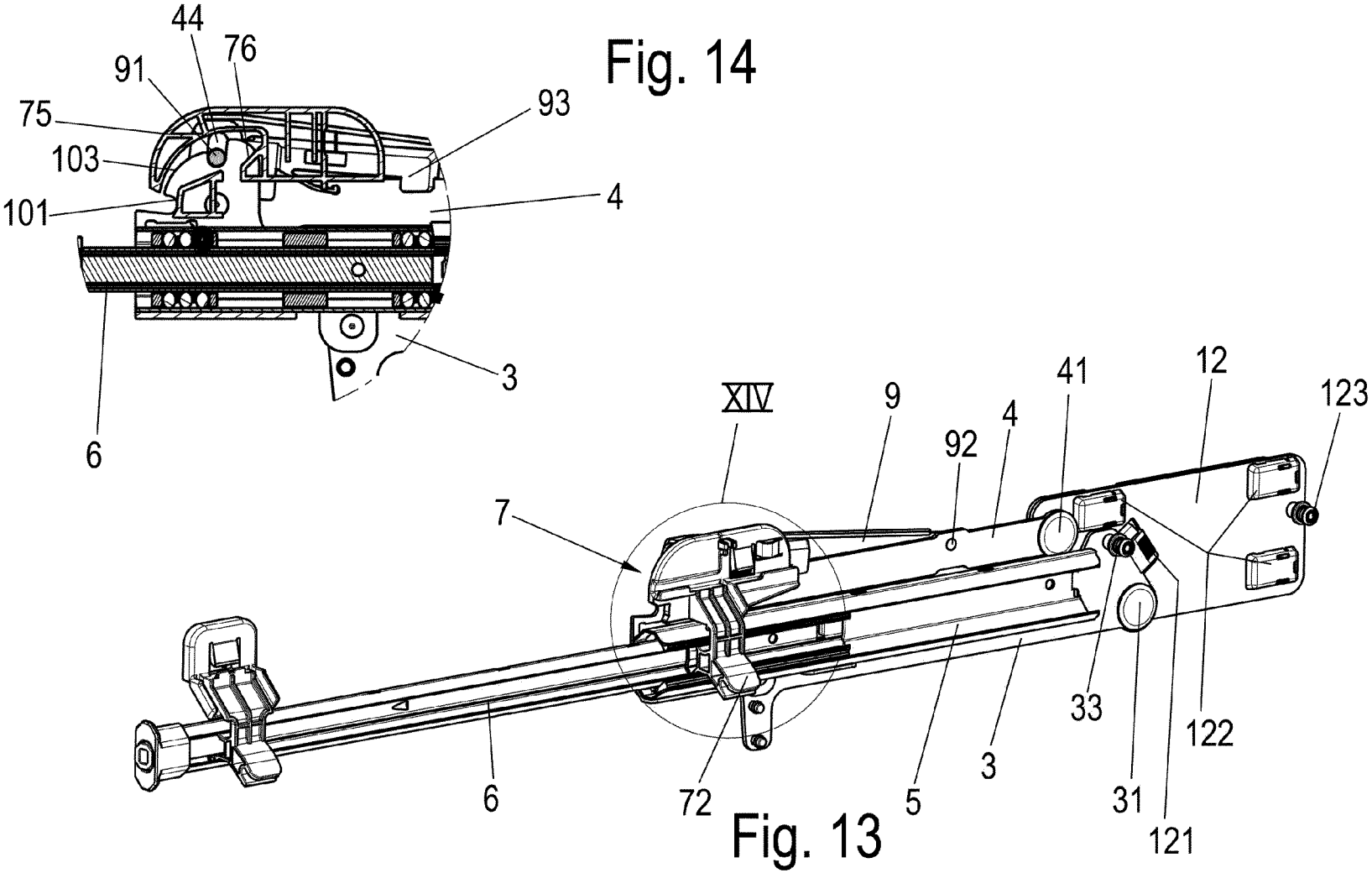
Figure 15:
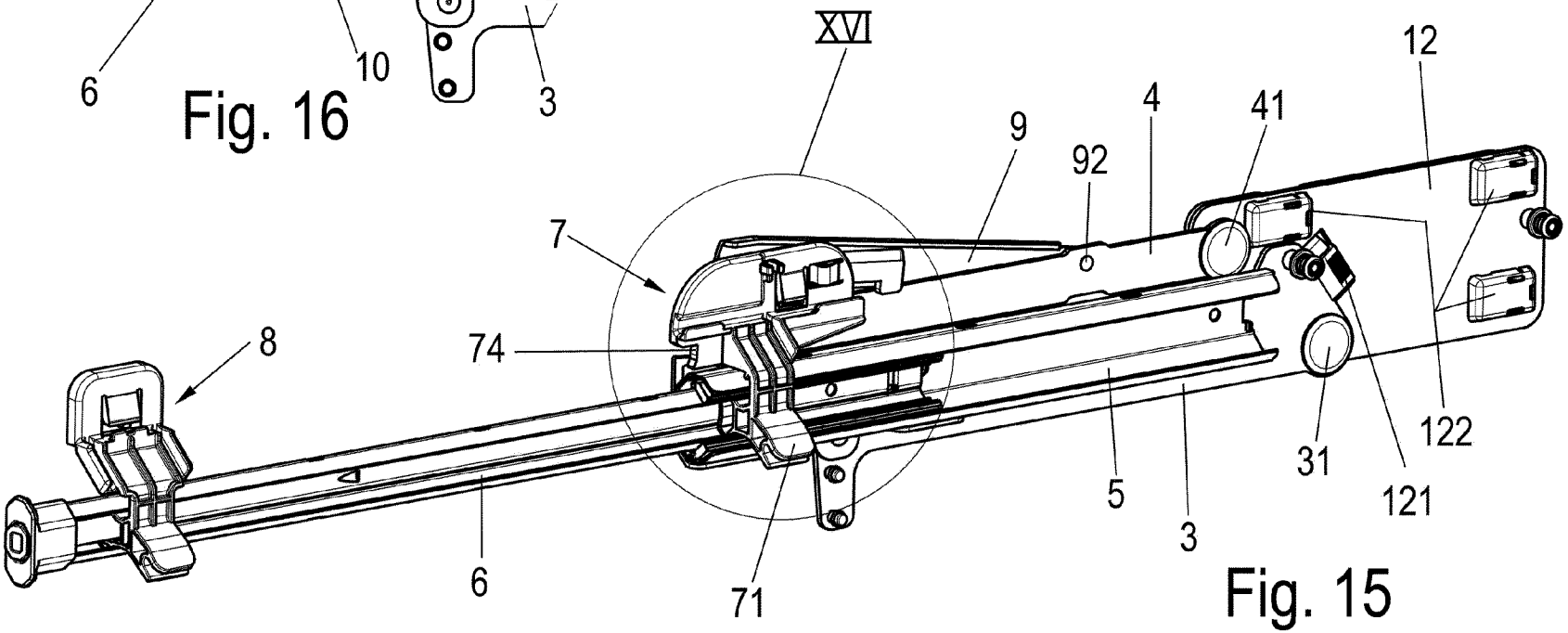

To guide the bolt 91 along the guide path 103, a guide 75 is provided on the rear side of the activator 7 facing the pivot arms 3, 4, which guide, together with the guide path 103, forms a guide channel in which the bolt 91 is guided during a raising operation of the sliding and pivoting mechanism, as is shown for example in FIGS. 9 and 10, until the pivot arms 3, 4 have reached their top end positions. In said position, shown in FIGS. 11 and 12, the bolt 91 abuts against a stop 104 of the plate 10 and at the same time blocks a further movement of the bolt 91. In said position, the web 9 is pulled with the bolt 91 by the spring element 94 in the direction of the second pivot arm 4 such that the bolt 91 slides along the stop 104 into the second locking groove 102 and consequently completely blocks a pivoting movement of the pivot arms 3, 4.

In said position, the rack 15, which is fastened on the running rail 6, is in its raised end position in which a user is able to load or unload the rack 15 without at the same time having to bend down. In this case, the locking mechanism ensures that the rack remains in said position and unwanted lowering, for example as a result of loading a rack 15 with a heavy object, is effectively prevented.

Figure 16:
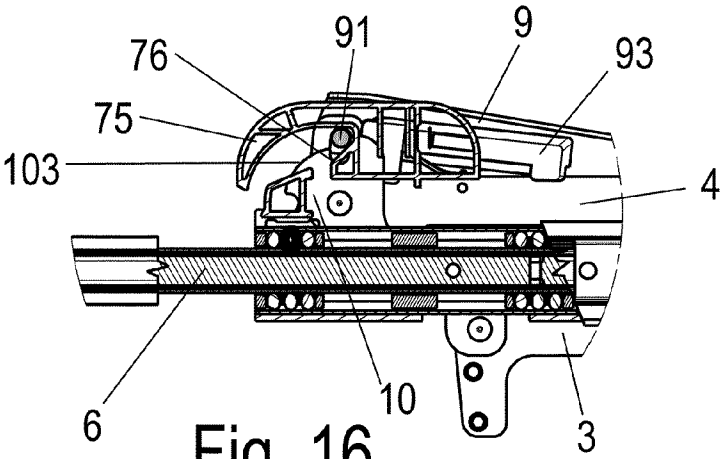
Figures 17, 18:
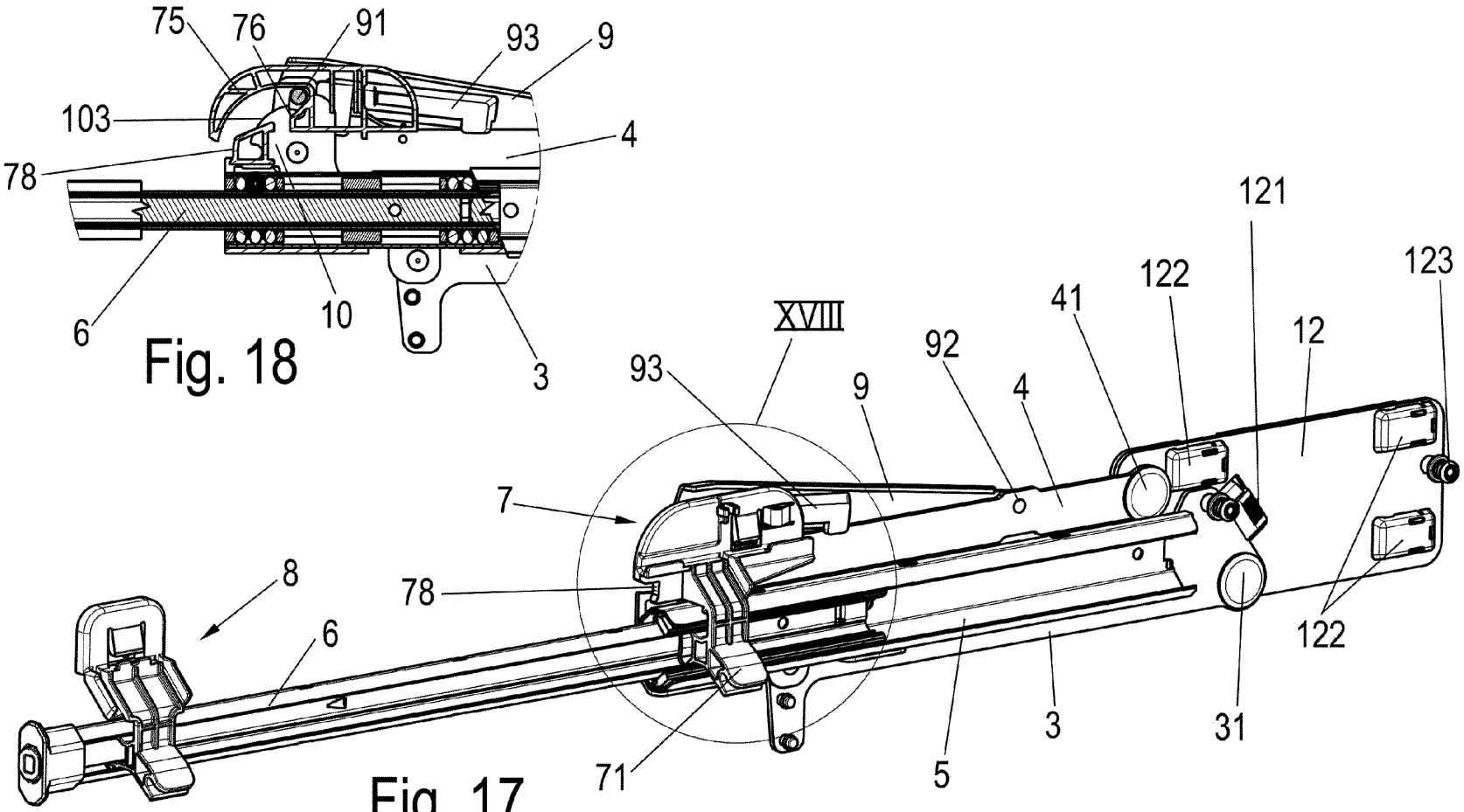
Figure 19:
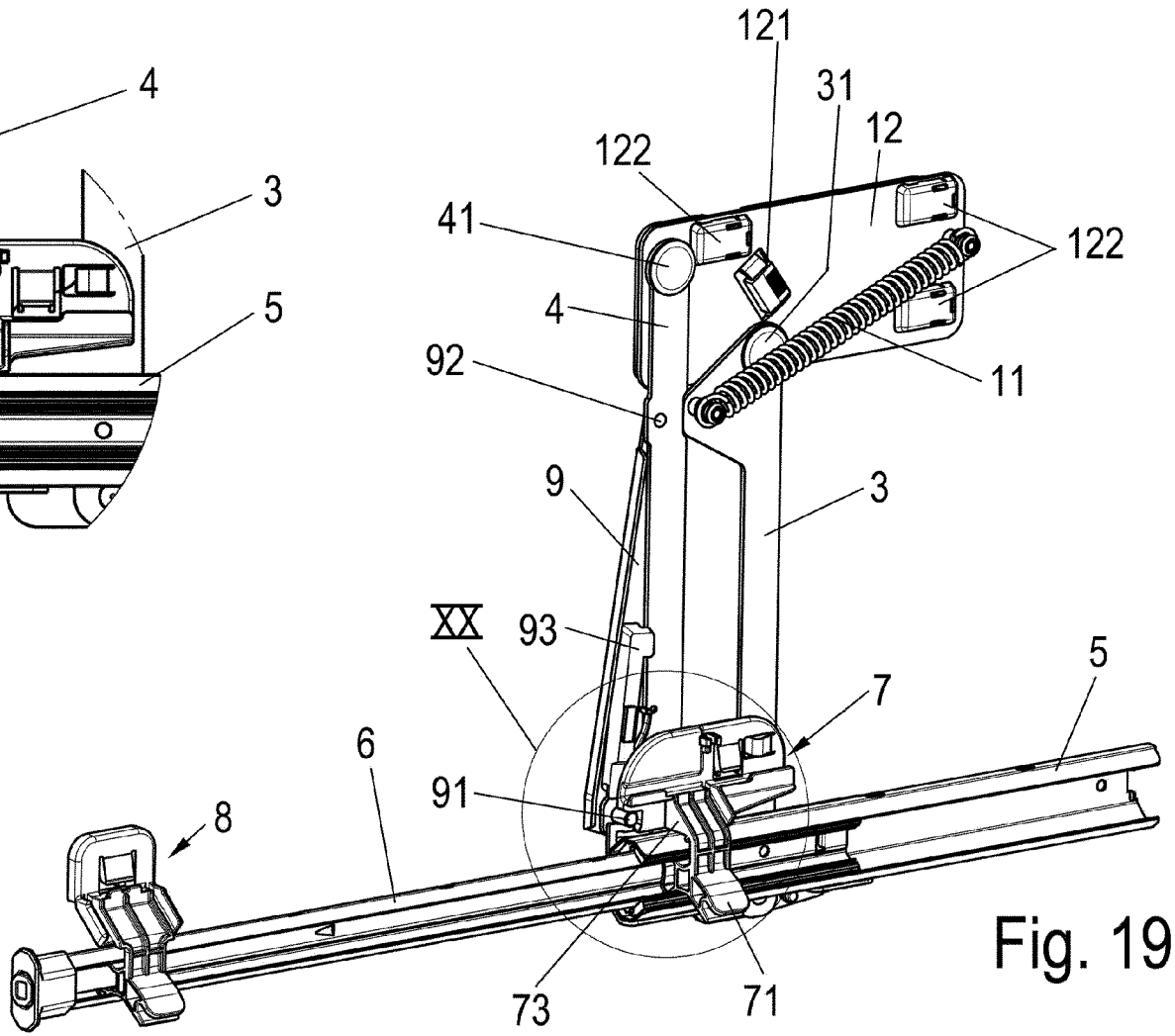
Figure 20:
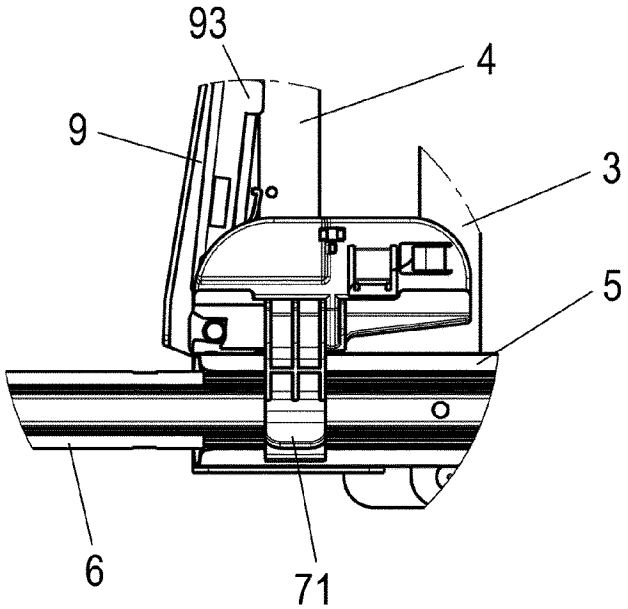
Figure 21:
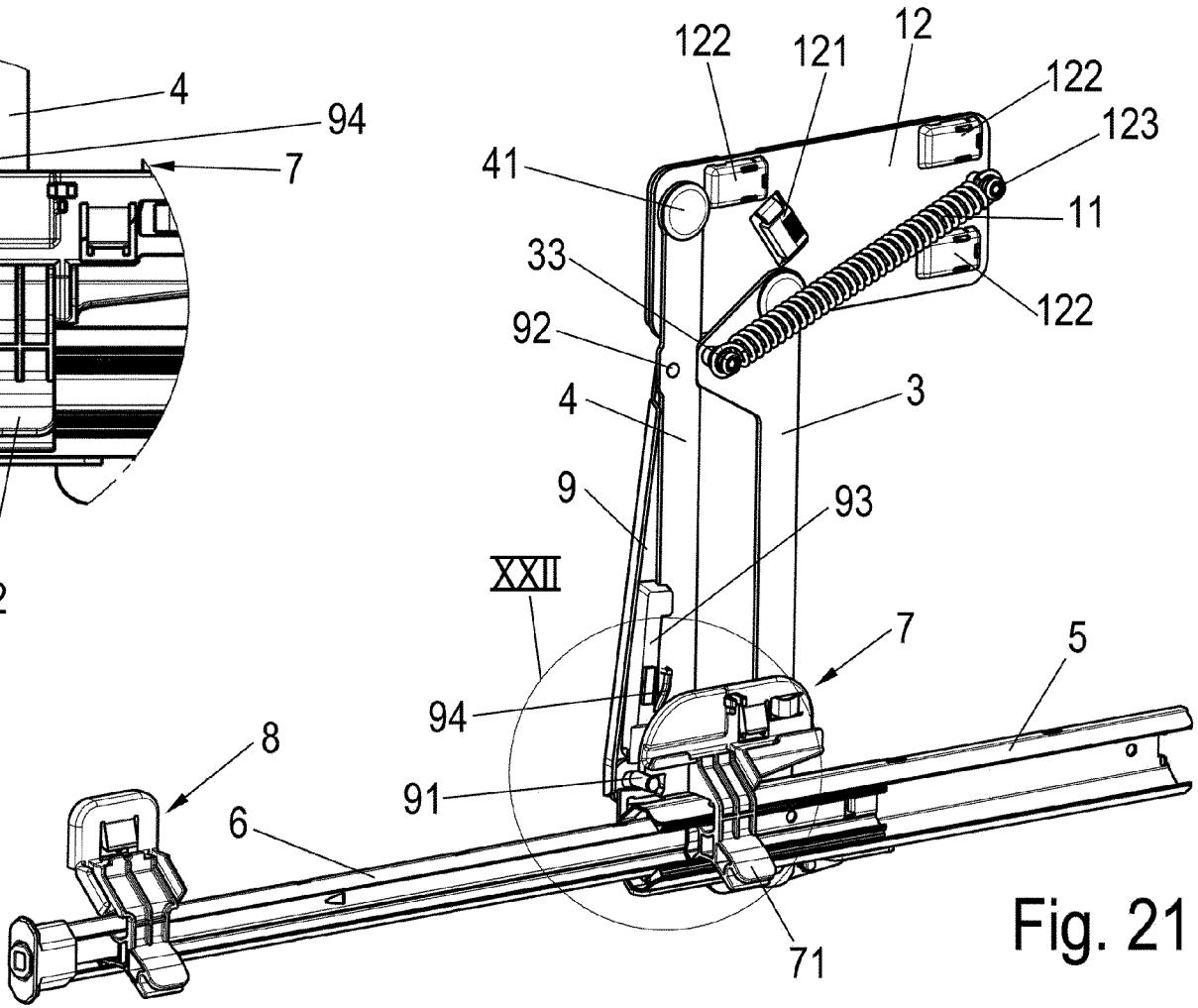
Figure 22:
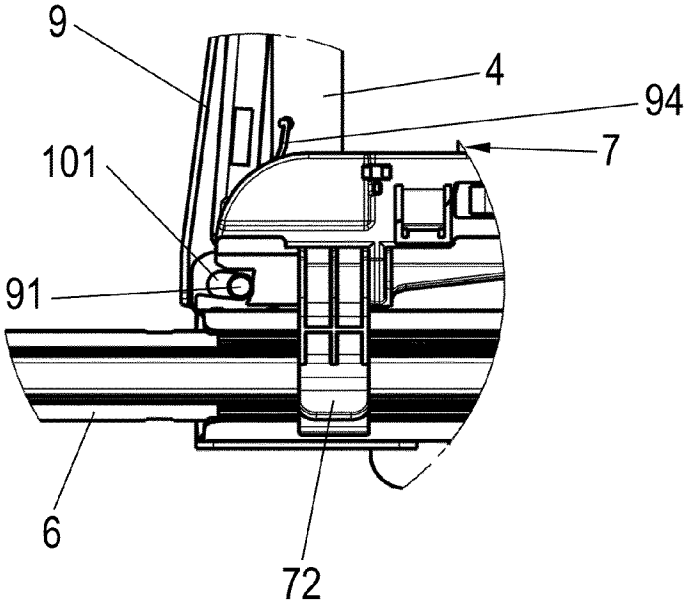

In order to move the sliding and pivoting mechanism back again into its starting position once said top end position has been achieved, the runner system is first of all pulled a little further in the direction of extension A. In this case, the bolt 91 is raised out of the locking groove 102 as a result of a ramp 76 which is realized on the activator 7, as is shown in FIGS. 16 and 18, such that the bolt 91 is then once again able to move along the guide path 103 of the plate 10 into the bottom position in the direction of the first locking groove 101, which is accompanied by a lowering of the guide rail 5 and of the running rail 6 as a result of the pivoting movement of the pivot arms 3, 4 until the lowered position, shown in FIGS. 19 and 20, is once again reached in which, as a result of the running rail 6 being moved back against the direction of extension A, the bolt 91 is once again pulled into the bottom locking groove 101 such that further pivoting of the pivot arms 3, 4 is once again blocked and the rack 15 or the running rail 6 is able to be moved in a linear manner completely back again into the body 2.

Figure 23:
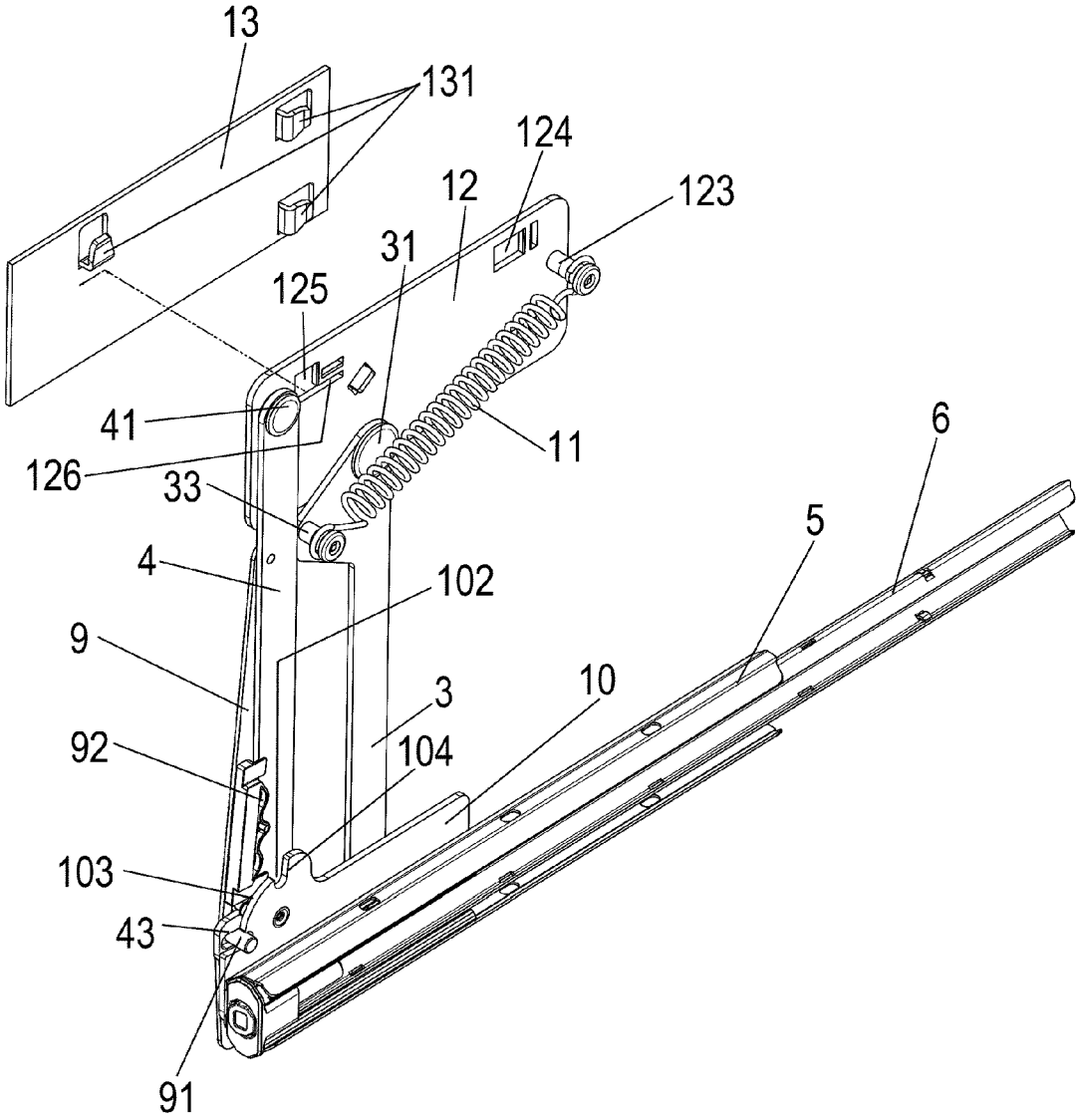
FIG. 23 shows a perspective view of an embodiment of a sliding and pivoting mechanism according to the disclosure with a two-part fastening plate for fixing the sliding and pivoting mechanism on a side wall of the body.
Figure 24:
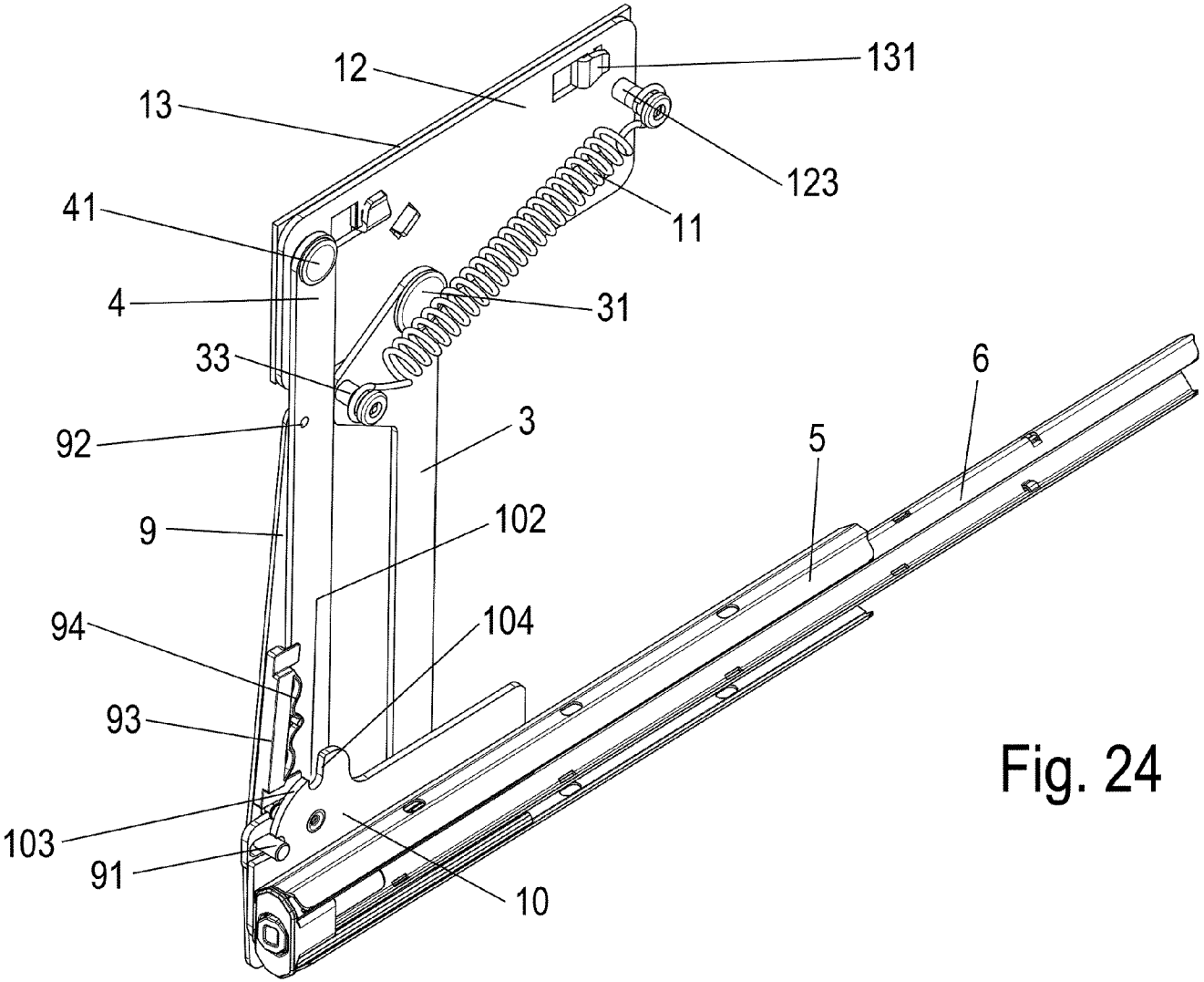
FIG. 24 shows a perspective view of an embodiment of a sliding and pivoting mechanism according to the disclosure with a fastening plate for fixing the sliding and pivoting mechanism on a side wall of the body.
Figure 25:
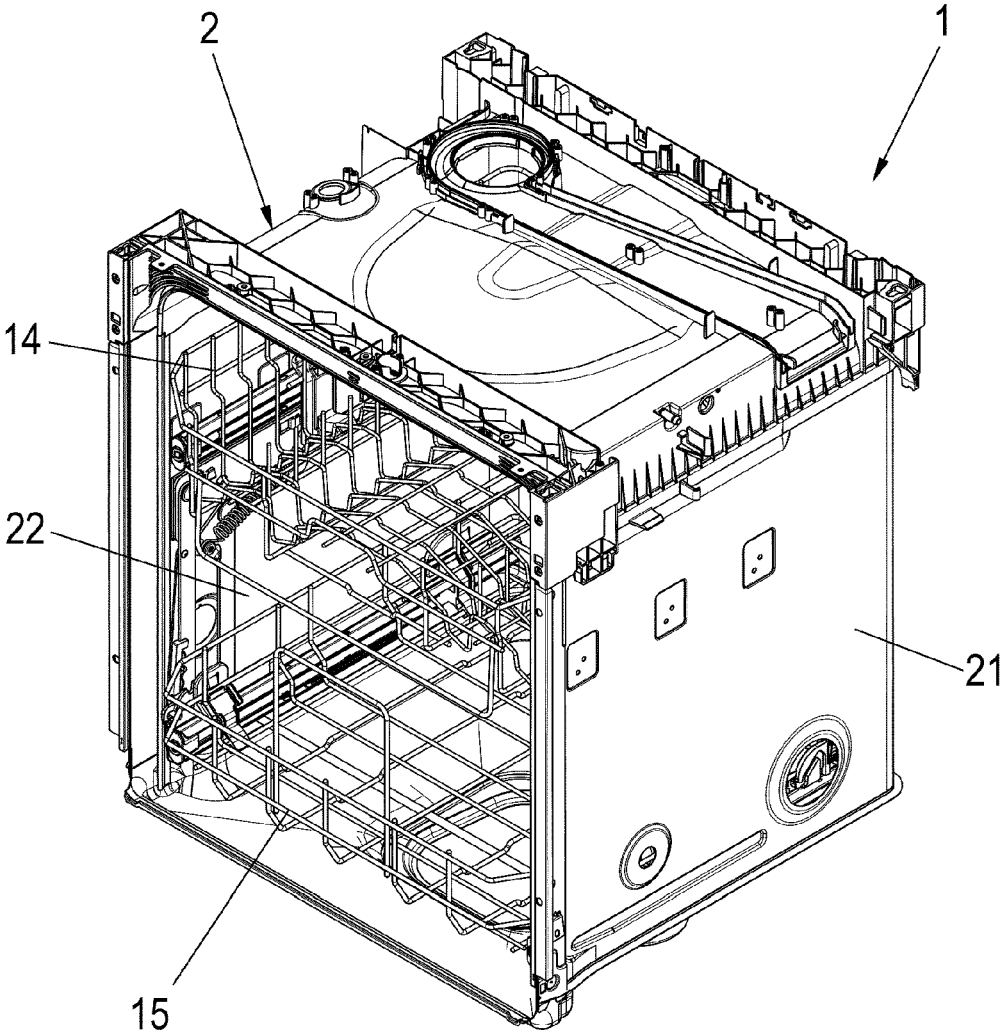
FIGS. 25 to 27 show perspective views of a body of a dishwasher with a top and bottom rack, wherein the bottom rack is provided with an embodiment of a sliding and pivoting mechanism according to the disclosure.
Figure 29A:
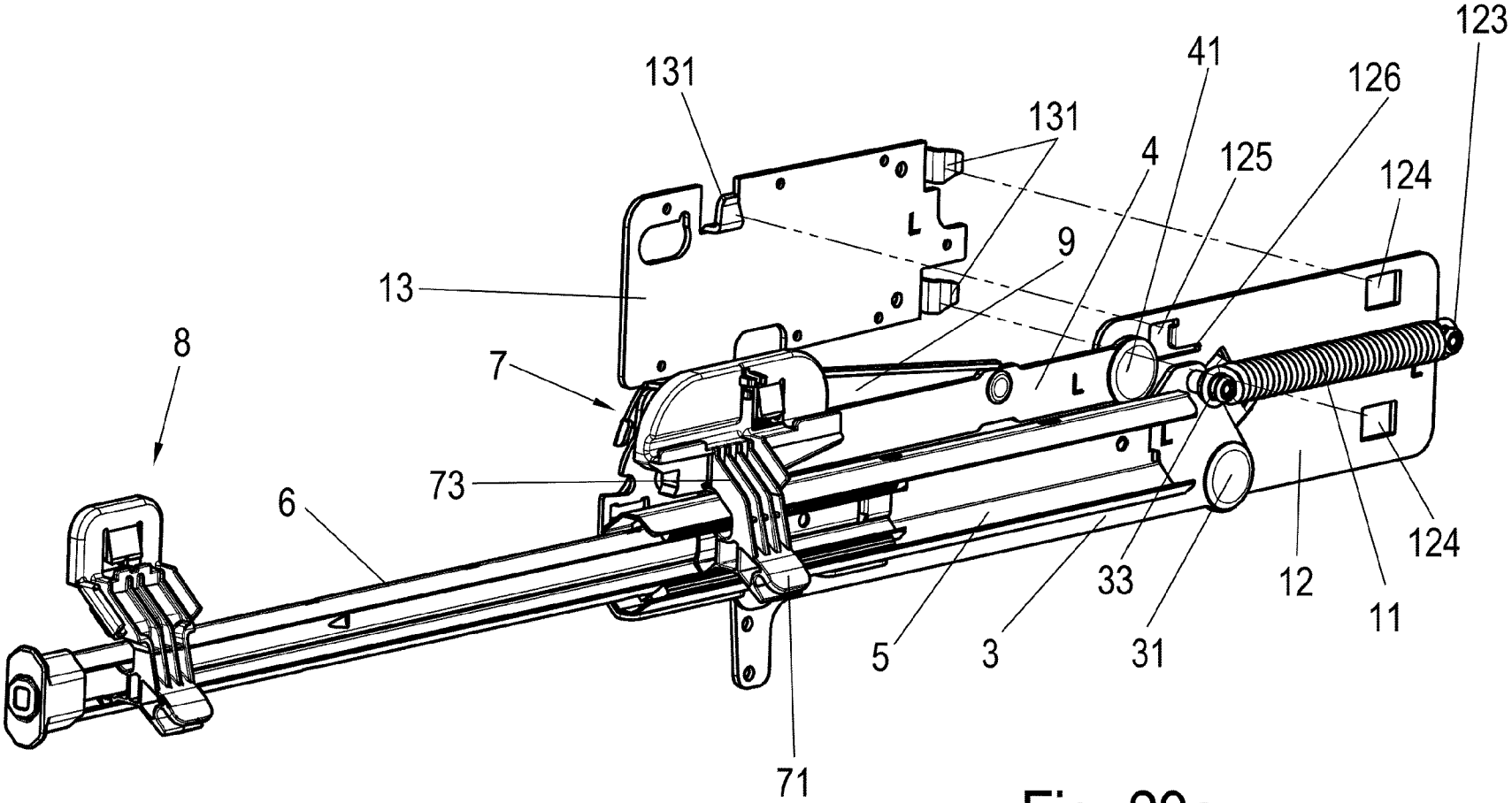
FIGS. 29*a* to *c* show perspective views of the sliding cabinet mechanism with a further embodiment of a fastening plate for fixing the sliding and pivoting mechanism on the side wall of a body.
Figure 29B:
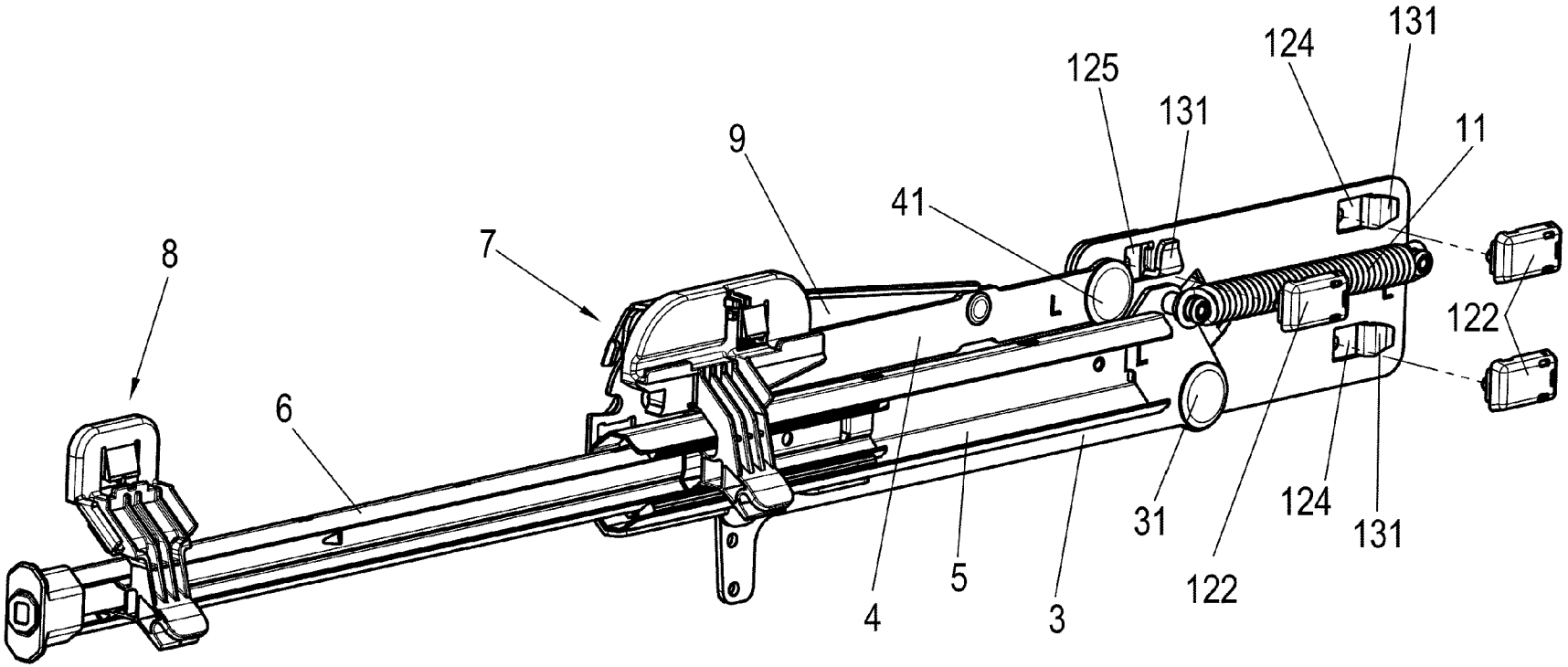
Figure 29C:
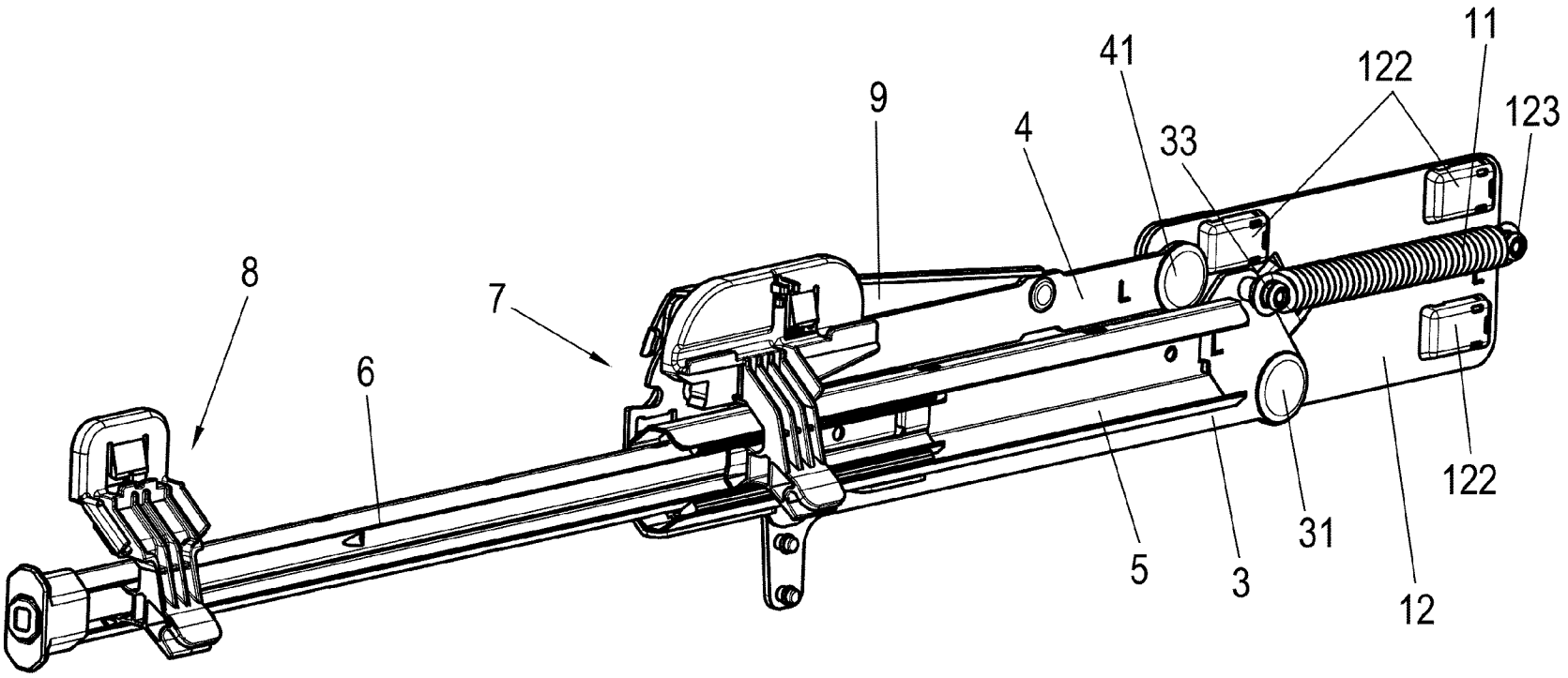

FIGS. 23, 24 and 29 additionally show another embodiment of a side wall holder which is formed in said exemplary embodiment by a side wall holder 12 and an auxiliary plate 13, the auxiliary plate 13 being fixed on the side wall 21, 22 of the body and the sliding and pivoting mechanism being able to be fixed by attaching the side wall holder 12 on the auxiliary plate 13. In this case, the side wall holder 12 comprises recesses 124, 125 for receiving hooks 131 which are provided on the auxiliary plate 13 and are insertable into the recesses 124, 125 of the side wall holder 12 and are lockable as a result of displacement in elongated slots 126 which extend from the recesses 125. In a preferred manner, once mounted in the recesses 124, 125 the hooks 131 are secured against loosening and contamination by retaining elements 122. The retaining elements 122, in this case, are produced in a preferred manner from plastics material and can be clipped onto the hooks 131 or into the recesses 124, 125. Other production materials, such as, for example, metal, or other securing methods are also conceivable.

The auxiliary plate 13 can also be realized integrally with the wall of an item of furniture or of a domestic appliance. The hooks 131 can also be secured individually at the corresponding positions in an item of furniture or a domestic appliance. The sliding and pivoting mechanism can be secured in the body of an item of furniture or of a domestic appliance in a materially bonding, positive locking and/or non-positive locking manner.

In a further embodiment, shown in FIGS. 32 to 36, a cover 17, which on the one hand serves for preventing contamination of the sliding and pivoting mechanism as well as also as (finger) protection and at least partially covers the side face of the sliding and pivoting mechanism, is mounted on the side of the sliding and pivoting mechanism remote from the rack 15.

The cover 17, in this case, is realized with multiple parts in the embodiment shown here and consists of a first cover part 171 and a second cover part 172. Realizing the cover 17 in one part is also conceivable.

The cover 17 or the cover parts 171, 172 preferably consist of a flat plastics material profile with recesses 173, 175 and/or openings 174 for surrounding a pivot joint 32, 42 and the web 9, which, in a preferred manner, is reinforced at least locally by means of ribs 176. The fastening of the cover parts 171, 172 is preferably effected without any tools, for example as a result of snapping on with the help of projections 177 which are integrally formed on the cover parts 171, 172.

In order to make the latching of the sliding and pivoting mechanism in the top locking position recognizable to the user, it is provided according to an embodiment to realize the locking process by means of audible feedback of the locking process by means of the spring element 95 which latches in or on a projection on the pivot arm 4 in an audible manner.

According to an alternative embodiment, the latching of the sliding and pivoting mechanism in the top locking position is visually recognizable to the user, as is shown in FIGS. 33 to 36.

Figures 33, 34:
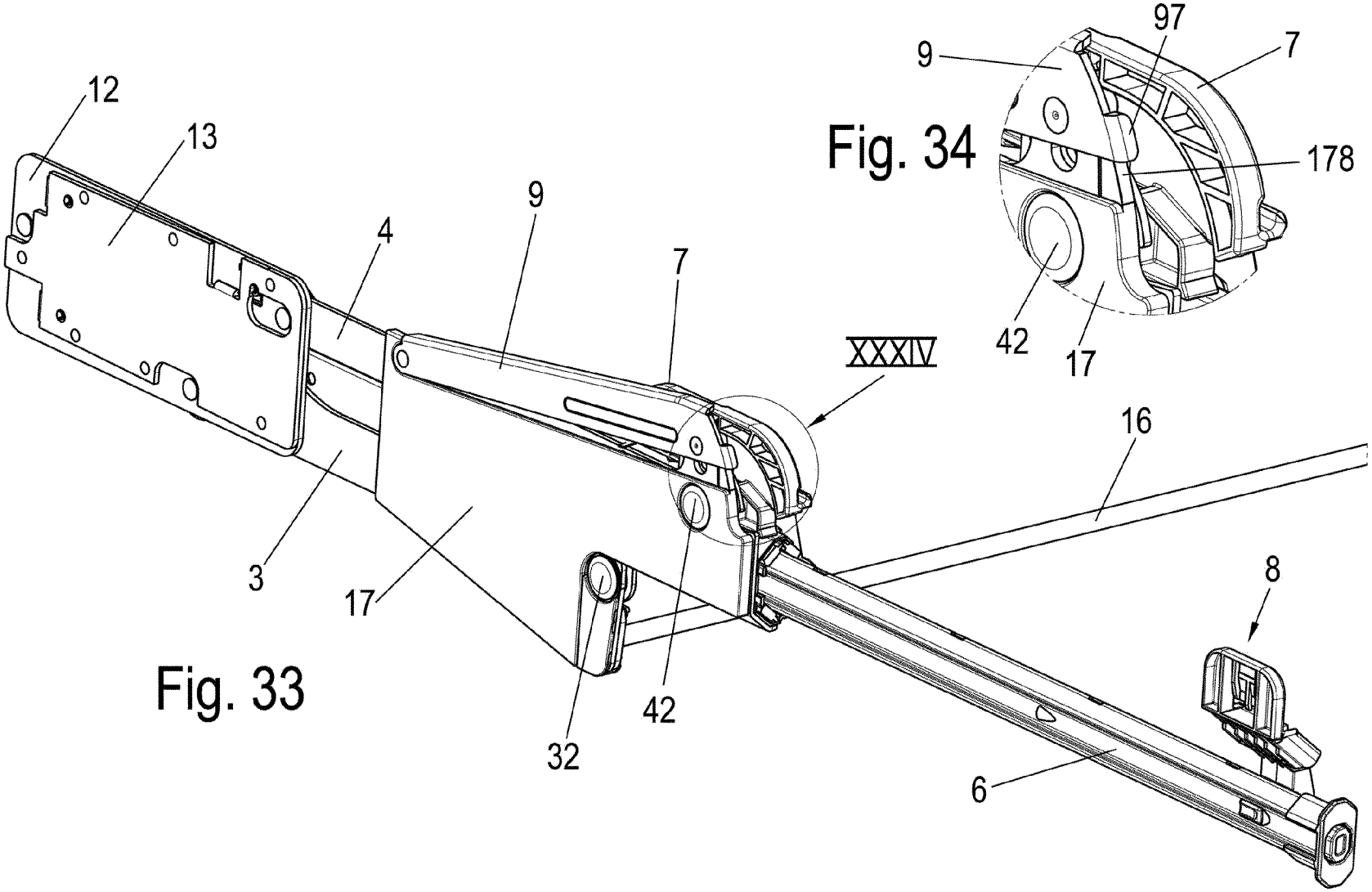

As can be seen in the representation of the detail in FIG. 34, a web 178 with a, for example, color-marked control strip, which is positioned such that in the non-locked position of the mechanism it can be viewed by the user and in the top locking position of the bolt 91 is covered by a lug 97 which is integrally molded on the web 9, is provided on the cover 17 for this purpose.

FIGS. 33 and 34 show the unlocked state where the bolt 91 is released out of the locking groove 102. In said position, the spacing between the web 9 in the region of the bolt 91 and the pivot arm 4 is large enough for the web 178 with the control strip to be visible.

Figures 35, 36:
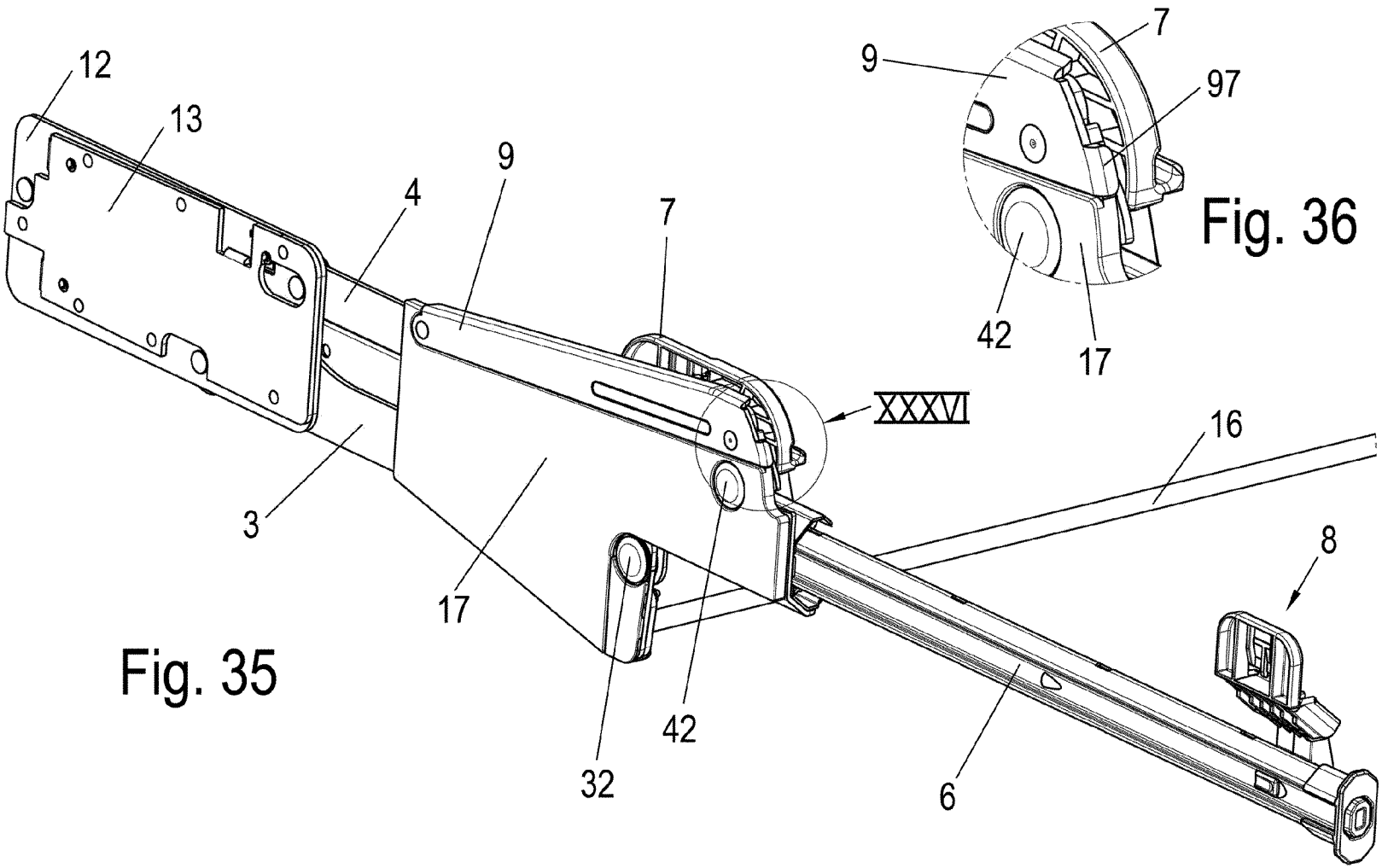
FIG. 36 shows a representation of a detail of the cutout marked with XXXVI in FIG. 35.

FIGS. 35 and 36 show the locked state where the web 9 abuts directly against the pivot arm 4 and is held by the spring element 95 in said position. The web 178 with the control strip is covered by the lug 97 in the locked position.

The invention claimed is:

1. A sliding and pivoting mechanism of a rack of an item of furniture or of a domestic appliance for pulling out and raising the rack from a body of the item of furniture or of the domestic appliance, said body having an inside and an outside and at least one side wall, said sliding and pivoting mechanism comprising at least two pivot arms which are rotatably securable to at least one of the at least one side wall of the body directly or through an intervening side wall holder with a first end parallel to a plane of the at least one side wall and which are arranged spaced part from one another in parallel, wherein a guide rail is secured on the respective second ends of the pivot arms so as to be pivotable in such a manner parallel to the plane of the side walls that the guide rail is pivotable from a bottom position inside the body into a raised, top position at least partially outside of the body, at least one running rail which is linearly displaceable in the guide rail and to which the rack is fastenable, wherein the sliding and pivoting mechanism comprises a locking mechanism, which is arranged on the guide rail and on one of the pivot arms and can be actuated by an activator which is fixed on the running rail, for preventing the running rail from simultaneously sliding and pivoting.

2. The sliding and pivoting mechanism as claimed in claim 1, wherein the locking mechanism comprises a web, which is held so as to be pivotable and resilient on one of the pivot arms, with a bolt which protrudes toward the guide rail and is guidable along a guide path, which is fastened on the guide rail, from a first locking position into at least one further locking position.

3. The sliding and pivoting mechanism as claimed in claim 2, wherein the guide path is embodied as a curve portion which is defined by a first locking groove and at least one further locking groove.

4. The sliding and pivoting mechanism as claimed in claim 2, wherein the guide path and the locking grooves are embodied on a plate which is connected fixedly to the guide rail.

5. The sliding and pivoting mechanism as claimed in claim 2, wherein a spring element, which holds the web and a second of the two pivot arms together proximate the bolt, is arranged between the web and the second pivot arm.

6. The sliding and pivoting mechanism as claimed in claim 5, wherein the spring element can be latched in an audibly perceivable manner in or on a projection which is provided on the pivot arm when the spring reaches a locking position in which the running rail may not simultaneously pivot and slide.

7. The sliding and pivoting mechanism as claimed in claim 1, wherein the activator, which is fixed on the running rail, comprises a first stop configured to allow the locking bolt to move in a direction of extension (A) of the running rail with respect to the guide rail to a position blocking a pivoting movement of the pivot arms in the first locking groove when the running rail is pulled out.

8. The sliding and pivoting mechanism as claimed in claim 1, wherein the activator, which is fixed on the running rail, comprises a guide which guides the locking bolt along the guide path when the pivot arms are pivoted.

9. The sliding and pivoting mechanism as claimed in claim 1, wherein the activator, which is fixed to the running rail, comprises a web in the form of a ramp operable to move the locking bolt in a direction of extension (A) out of a position wherein the locking bolt blocks a pivoting movement of the pivot arms in the second locking groove when the running rail is pulled out.

10. The sliding and pivoting mechanism as claimed in claim 1, wherein the activator comprises at least one fastening element for fixing the rack to the activator.

11. The sliding and pivoting mechanism as claimed in claim 1, wherein the locking bolt is guided in a guide groove of a second guide arm which is aligned perpendicular to the longitudinal extension of the second guide arm.

12. The sliding and pivoting mechanism as claimed in claim 1, wherein at least one raising, lowering or raising and lowering aid, which is secured on one of the at least one side wall of the body directly or through an intervening side wall holder and on one of the pivot arms, is provided for supporting a pivoting movement of the pivot arms.

13. The sliding and pivoting mechanism as claimed in claim 1, wherein a side wall holder, on which the arms and a raising, lowering or raising and lowering aid of a height-adjustment mechanism are secured, is fastened on at least one of oppositely located ones of the at least one side wall of the body.

14. The sliding and pivoting mechanism as claimed in claim 13, wherein the raising and lowering aid is embodied as an energy storage means.

15. The sliding and pivoting mechanism of claim 14, wherein the energy storage means is a tension spring.

16. The sliding and pivoting mechanism of claim 14, wherein the energy storage means is a pneumatic spring.

17. The sliding and pivoting mechanism as claimed in claim 1, wherein a cover, which covers a side face of the sliding and pivoting mechanism at least in part, is arranged on a side of the sliding and pivoting mechanism remote from the rack.

18. The sliding and pivoting mechanism as claimed in claim 17, wherein a web with a visually recognizable control strip is provided on the cover, the web operable to indicate whether the sliding and pivoting mechanism is in a locking position in which the running rail may not simultaneously pivot and slide or a non-locking position in which the running rail may simultaneously pivot and slide.

19. An item of furniture having a furniture body and at least one rack which is fixed in the furniture body with a pivoting and sliding mechanism, by way of which the rack can be pulled and raised out of the furniture body, wherein the pivoting and sliding mechanism is embodied according to claim 1.

20. A domestic appliance comprising the sliding and pivoting mechanism according to claim 1 and a rack attached to the sliding and pivoting mechanism, the sliding and pivoting mechanism operable to enable the rack to be pulled out and raised from an interior of the domestic appliance.

* * * * *